US006834415B2

(12) United States Patent
Almestad

(10) Patent No.: US 6,834,415 B2
(45) Date of Patent: Dec. 28, 2004

(54) CONCEALED HINGE AND METHOD OF INSTALLATION

(76) Inventor: Henry C. Almestad, 1261 Contra Costa Dr., El Cerrito, CA (US) 94530

( * ) Notice: Subject to any disclaimer, the term of this patent is extended or adjusted under 35 U.S.C. 154(b) by 0 days.

(21) Appl. No.: 10/334,257

(22) Filed: Dec. 31, 2002

(65) Prior Publication Data

US 2004/0123425 A1 Jul. 1, 2004

(51) Int. Cl.[7] ..... E05D 7/00

(52) U.S. Cl. ..... 16/221; 312/329; 49/398; 49/400

(58) Field of Search ..... 16/221; 312/326, 312/329; 49/381, 398, 400

(56) References Cited

U.S. PATENT DOCUMENTS

| | | | | |
|---|---|---|---|---|
| 384,808 | A | 6/1888 | Wiederer | 359/854 |
| 453,803 | A | 6/1891 | Faulhaber et al. | 16/314 |
| 963,352 | A | 7/1910 | Blackman | 220/62 |
| 2,385,169 | A | 9/1945 | Stone | 16/390 |
| 2,661,495 | A | 12/1953 | Kallenberg | 16/315 |
| 2,901,782 | A | 9/1959 | Ullman, Jr. | 49/398 |
| 3,006,039 | A | 10/1961 | Brydolf | 49/398 |
| 3,131,422 | A | 5/1964 | Agius | 16/392 |
| 3,197,804 | A | 8/1965 | Ennis | 16/383 |
| 3,299,573 | A | 1/1967 | Gustafson | 49/388 |
| 3,323,163 | A | 6/1967 | Goodnow | 16/235 |
| 3,506,326 | A | 4/1970 | Tantillo | 312/227 |
| 3,604,154 | A | 9/1971 | Curran | 49/501 |
| 3,662,493 | A | 5/1972 | Foltz | 49/388 |
| 4,157,599 | A | 6/1979 | Holmes | 16/278 |
| 4,177,540 | A | * 12/1979 | Gorton | 16/335 |
| 4,200,956 | A | 5/1980 | Ullman, Jr. | 16/235 |
| 4,704,766 | A | 11/1987 | Almestad | 16/236 |
| 4,736,491 | A | 4/1988 | Mertes | 16/358 |
| 5,232,277 | A | 8/1993 | Cassady et al. | 312/296 |
| 5,931,104 | A | 8/1999 | Horn et al. | 109/59 R |

* cited by examiner

*Primary Examiner*—Thomas B. Will
*Assistant Examiner*—Tara L. Mayo
(74) *Attorney, Agent, or Firm*—James R. Cypher; Charles R. Cypher

(57) ABSTRACT

A concealed hinge for doors in furniture and cabinets installed with screws in which the weight of the door rests on the hinge pivot point and is borne by the frame of the cabinet. The hinge is preferably installed using a template. The hinge includes an elongated door plate member having a projection member, a hinge base plate member, pivot member connected to the distal end of the door plate projection member and to the hinge base plate member. The pivot means is located so that the arc scribed by the front pivot corner of the door does not intersect the side face portion of the vertical frame member of the cabinet.

11 Claims, 17 Drawing Sheets

CONCEALED HINGE AND METHOD OF INSTALLATION

BACKGROUND OF THE INVENTION

This invention relates to hinges for cabinet doors which are designed to be concealed when the door is closed. The present invention discloses a hinge which is an improvement of my Concealed Hinge, Almestad U.S. Pat. No. 4,704,766 granted Nov. 10, 1987.

The present application presents an improvement over my patented hinge in two major areas. First, the present invention has greater adjustability than the patented hinge. Second, the hinge of the present invention is easier to install.

In the present invention, the angle of the bottom edge of the door with respect to the frame may be adjusted. In the patented hinge, this adjustment was not possible.

Installation of the hinges of the present invention take less time and are easier to install than the hinges of U.S. Pat. No. 4,704,766 by eliminating certain structural members of the '766 hinge and modifying others, and by providing a simple paper template.

Specifically, referring to U.S. Pat. No. 4,704,766, the horizontal flange except projection 25 of door plate member 12 and openings 17 and 49 punched therein are eliminated. It is unnecessary to form a bend between the horizontal flange of door plate member 12 and rear side member 31. Further, side angle member 26 on base plate member 19 is eliminated. As shown in FIG. 4 of U.S. Pat. No. 4,704,766, the portion of the base plate member 19 between bend lines 35 and 37 is eliminated as well as the need to bend the base plate member 19 along lines 35, 36, and 37. Openings 27 in side angle member 26 are eliminated.

Finally, as shown in FIG. 4 of U.S. Pat. No. 4,704,766, it was necessary to form a routed portion 33 with a special tool in the bottom edge 6 of door 1to receive the horizontal portion of door plate member 12. In the present application, this special routing is eliminated. Elimination of carpentry work on the door is a labor saving. The hinge of the present application is fastened to the door with screws on the backside of the door only, whereas the hinge of U.S. Pat. No. 4,704,766 was fastened to the bottom edge 6 of the door as well as the back side of the door 1.

The hardware of the present invention is simply attached to the door by placing it flush with either the top or bottom edge of the door and flush with the side of the door. This operation does not need a template for marking holes. The hardware is simply laid on the door and a mark for the holes is made on the backside of the door.

The template is only needed to mark the screw holes on the base and top of the cabinet and for marking the pivot clearing holes.

The thickness of the door plate hinge on the prior art Almestad U.S. Pat. No. 4,704,766 was 1/16" whereas the new plate of the present invention is thinner (20 Gauge (1/32"). The fit of the door within the cabinet frame is tighter and leaves less gap.

For partially pre-finished furniture and cabinets, all the holes could be marked and predrilled in the factory. The customer would not have to use any templates.

As stated above, the hinges of the present invention are easier to install than the hinges described in my U.S. Pat. No. 4,704,766 by eliminating certain structural members of the hinge and modifying others, and by providing a simple paper template.

Specifically, the '766 hinge required the installer to make an accurate measurement of the thickness of the door. A line was then drawn on the base in precise alignment with the front edge of the cabinet. Finally, the base of the hinge was laid on the base of the cabinet with part of the hinge in precise overlayment with this line. The screw attachment openings were then marked in the cabinet. While this operation is fairly easy, the problem gets more complicated when your have to repeat this procedure to mark the cabinet for the upper hinge. Specifically, marking lines on the underside of the upper portion of the cabinet and then holding the hinge on this line while looking upwardly, is not easy while the procedure is workable for a workman who has installed several hinge in several cabinets, the average do-it-yourselfer, is not a good candidate for this job; especially when he completes the work and finds that the door is out of alignment and further adjustment or even starting over again is required.

All of the foregoing measurements and operations which require precision and the handling of the hinge member in awkward positions is replaced by using a simple paper template to locate the hinge base plate member. The chance of making an error is practically eliminated because the template is only placed against two edges; viz. the front edge of the cabinet and the front edge of the door. There are only two lateral edges that are used; viz. the inside edge of the cabinet or stiles of the cabinet and the edge of the door.

SUMMARY OF THE INVENTION

The primary advantage of the hinge of the present invention over the Almestad hinge of U.S. Pat. No. 4,704,766 is that it is easier and faster to install. Easier and faster installation,is believed to be crucial to a "do-it-yourselfer" (DIYer) in whether he or she will tackle the job of making his or her own cabinets or deciding to pay a much greater amount to have a professional build the cabinet. Further in this age of Home DepotK, IKEDAK stores and other retailers that specialize in furniture and cabinets which are only partly assembled and some assembly is left to the customer, it is believed that easy and fast installation is the difference between commercial success and failure. Such stores will only use hardware which meets the foregoing classification.

The ease and swiftness of installation is primarily due to two reasons: (1) the present hinge lends itself to the use of a simple paper template that the DIYer can understand and use in installing the hinge to the cabinet. (2) The improved hinge attaches to the rear face of the cabinet door rather than the top or bottom edge of the door.

The unique advantage of the present invention is the fact that the hinge can be very light and small as the entire weight of the door is borne by the pivot which rests on the base of the cabinet. Secondly, some prior art hinges place the pivot point outboard of the base of the cabinet which means that the lever arms of the hinge must be strong enough to bear the weight of the door.

Installation is basically achieved by first locating the hinges on the door and cabinets by marking the screw holes in the base and door and for marking the pivot clearance hole or depression in the door and cabinet. Door face plate member is first attached to the rear face of the cabinet door with screws. Cabinet base plate member is then attached to the base of the cabinet with screws. The upper part of the cabinet door is then attached to the cabinet in the same manner with hinges which are identical to, but mirror images of the lower hinge.

Finally, adjustment of the angle of the lower edge of the door with respect to the cabinet frame may be adjusted by eliminating the horizontal portion of door plate member on the patented Almestad hinge and providing a slotted opening in the vertical portion of the door plate member permitting adjustment of the door with respect to the hinge in a vertical direction.

The hinge of the present invention is primarily used for wood doors, but the composition of the door may also be made of plastic, or glass.

INSTALLATION OF THE HINGE OF THE PRESENT INVENTION

A method of installing the hinges for a single door in the frame includes the steps of: creating a template with indicia locating the elongated fastener openings and the pivot means in the base plate member with respect to the planar front face and the planar side face of the frame; placing the template alternately on the top and bottom bases of the frame in alignment with the planar front face of the frame and the planar side face of the frame; marking the location of the elongated fastener openings and pivot clearances alternately on the planar top and bottom bases; forming depressions in the top and bottom bases for clearance of the pivot means; placing the door plate members respectively on the rear face of the door with the lower edge of the door plate member in registration with the bottom edge face of the door and the side edge of the door plate member in registration with the planar end face of the door and inserting fasteners through the elongated fastener openings into the door, and then installing the other door plate member in like manner in the door adjacent the top edge face; setting the door in the frame; and inserting fasteners respectively through the elongated fastener openings in the base plate members and into the marked locations of the elongated fastener opening on the planar top and bottom bases.

Marking the locations of the oval holes and pivot locations may be done with a sharp awl, or any similar instrument. Where self drilling screws are not used, it is preferable to prethread the holes for the screws with a screw starter. The depression for the pivot clearance is preferably formed by drilling a shallow hole.

In order to obtain a good fit of the door plate member with the door, the portion of the door edge which registers with the bend in door plate member where the protrusion attaches should be formed to tightly register with the bend in the lower edge of the door plate member. This may be done by lightly preparing the door edge by rubbing with fine sandpaper to slightly round the inside edge of the door.

Of course, after the door hinges are installed, adjustments should be made to property fit the door within the frame and the screws tightened. Screws then should be inserted through the remaining fastener openings in the hinges and tightened.

DESCRIPTION OF THE PREFERRED EMBODIMENTS OF THE INVENTION

Figure 1:
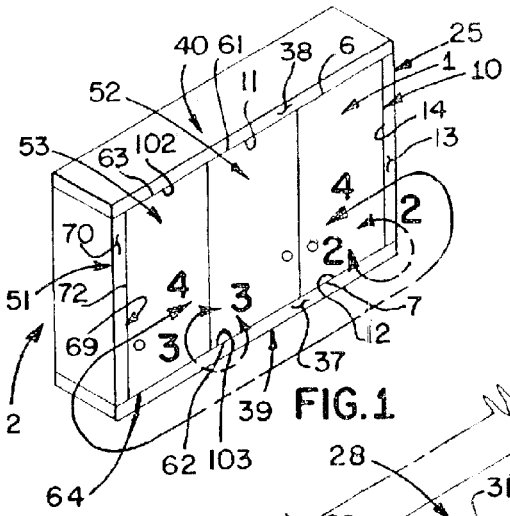
FIG. 1 is a perspective view of a cabinet shown on a reduced scale using the hinges of the present invention.
Figure 2:
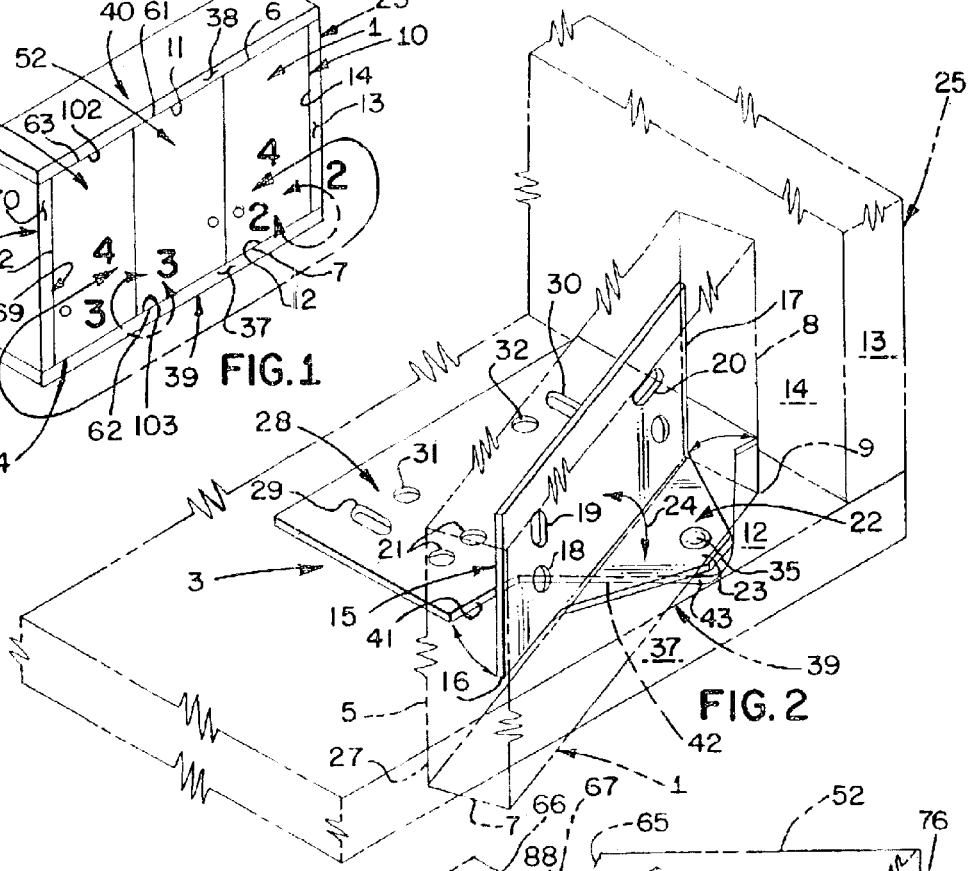
FIG. 2 is a perspective view on an enlarged scale taken along lines 2—2 of FIG. 1 showing a single door hinge of the present invention. A portion of the cabinet is illustrated in phantom line. The single door hinge is also shown in FIGS. 5 and 5A.

The first and simplest form of the invention of the present is illustrated in FIGS. 1 and 2 of the drawings. Other views are illustrated in parts of FIGS. 4, 5, 5A and 6.

The first form of the invention is a pair of upper and lower hinges for a single door. Specifically, the first form of the invention is a combination, including, a first door 1, a frame 2, having a bottom horizontal frame member 39 having a planar bottom frame member portion 12, a top horizontal frame member 40 having a planar top frame member portion 11, and a first generally vertical frame member 25, and a pair of concealed hinges 3 for the first door 1 movable from a closed to an open position, the first door 1 having a substantially planar front face portion 4 and a rear substantially planar face portion 5, and generally parallel planar top and bottom edge face portions 6,7 and a substantially planar end face portion 8 intersecting the substantially planar front face portion 4 and forming a front pivot corner 9 and mounted in the frame 2 and the first generally vertical frame member 25 having a substantially planar front face portion 13 and presenting a substantially planar side face portion 14 generally parallel to and closely spaced from the planar first door end face portion 8 and the pivot corner 9 when the first door 1 is in the closed position.

Each of the concealed hinges 3 include a pair of elongated door plate members 15 each having a lower edge 16 and a side edge 17 formed with fastener openings 18, 19, 20 therethrough, and a projection member 22 extending from the lower edge 16 of the door plate member 15 to a narrow distal end 23 and at an angle 24 thereto and each of the door plate members 15 being connected to respective upper (not shown) and lower 27 portions of the rear face portion 5 of the first door 1 adjacent the first door front pivot corner 9.

Each of the concealed hinges 3 include a hinge base plate member 28 formed with fastener openings 29–34 connected to the respective planar top and bottom frame member portions 11,12 of the top and bottom frame members 40,39, Pivot means 35 is connected to the distal end 23 of the door plate projection member 22 and to the hinge base plate member 28.

The pivot means 35 is located with respect to the elongated door plate member 15 and the hinge base plate member 28 adjacent the substantially planar front face 4 portion of the first door 1 and adjacent the planar first door end face portion 8 at a point sufficient distance from the planar side face portion 14 of the first vertical frame member 25 and from the substantially planar front face portion 4 of the first door 1 so that the arc 36 scribed by the front pivot corner 9 of the door 1 adjacent the first vertical frame member 25 when the first door 1 is pivoted for rotation 44 about the pivot means 35 from the closed to open positions does not intersect the planar side face portion 14 of the first vertical frame member 25, and the planar front face portion 4 of the first door 1 when in the closed position is substantially parallel to the planar front face portion 13 of the first vertical frame member 25.

At least one of the fastener openings 19 in the door plate member 15 is elongated in its vertical direction to permit adjustment of the relative attachment of the first door 1 in a vertical direction.

At least two of the fastener openings 29,30 in the hinge base plate member 28 are elongated in a direction at right angles to the first door 1 when the first door 1 is in its closed position so as to permit front to rear adjustment of the location of the hinge base plate member 28 relative to frame opening 10 defined by a planar front face portion 13 of the first vertical frame member 25, planar front face portion 37 of the bottom frame member 39 and, planar front face portion 38 of the top horizontal frame member 40.

A more specific description of the present invention and specifically, the single door set forth above the combination is described as follows.

The hinge base plate member 28 is formed with a front edge 41 and a projection member 42 extends from the front edge 41 to a narrow distal end 43; and the pivot means 35 is connected to the narrow distal end 43 of the base plate projection member 42 and the narrow distal end 23 of the door plate projection member 22.

The method of installing the hinges 3 illustrated in FIG. 2 and the first door 1 in the frame 2 comprises the steps of: creating a template 215 with indicia $29^1$–$34^1$ and $29'^1$–$34'^1$; locating the elongated fastener openings 29–34 and 29'–34' (not shown) and indicia $35^1$ and $35'^1$ locating the pivot means 35 in the hinge base plate member 28 with respect to the planar front face portion 37 and the planar side face portion 14 of the frame 2; placing the template 215 alternately on the top and bottom frame member portions 11, 12 of the frame 2 in alignment with the planar front face portion 37 of the frame 2 and the planar side face portion 14 of the frame 2; marking the location of the elongated fastener openings 29–34 and 29'–34' (not shown) and pivot clearances 35, alternately on the planar top and bottom frame member portions 11, 12; forming depressions $35_1$ in the top and bottom frame member portions 11, 12 for clearance of the pivot means 35; placing the door plate members 15 respectively on the substantially planar rear face portion 5 of the door 1 with the lower edge 16 of the door plate member 15 in registration with the bottom edge face 7 of the door 1 and the side edge 17 of the door plate member 15 in registration with the substantially planar end face 8 portion of the door 1 and inserting fasteners through the elongated fastener openings into the door, and then installing the other door plate member (identical to door plate member 15) in like manner in the door 1 adjacent the top edge face 6 of the door 1; setting the door 1 in the frame 2; and inserting fasteners respectively through the elongated fastener openings 29–34 in the hinge base plate members 28 and into the marked locations of the elongated fastener openings in the planar top and bottom frame member portions 11, 12.

Figure 3:
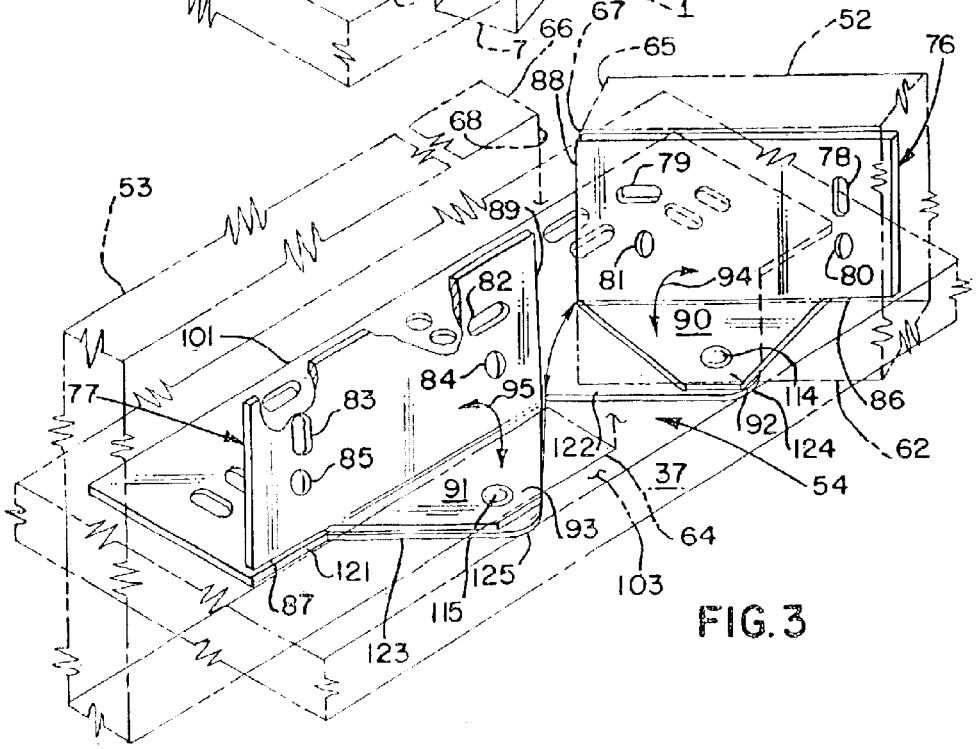
FIG. 3 is a perspective view on an enlarged scale taken along line 3—3 of FIG. 1 showing another form of the present invention. A portion of the cabinet and portions of two doors are illustrated in phantom line.
Figures 4, 6, 7:
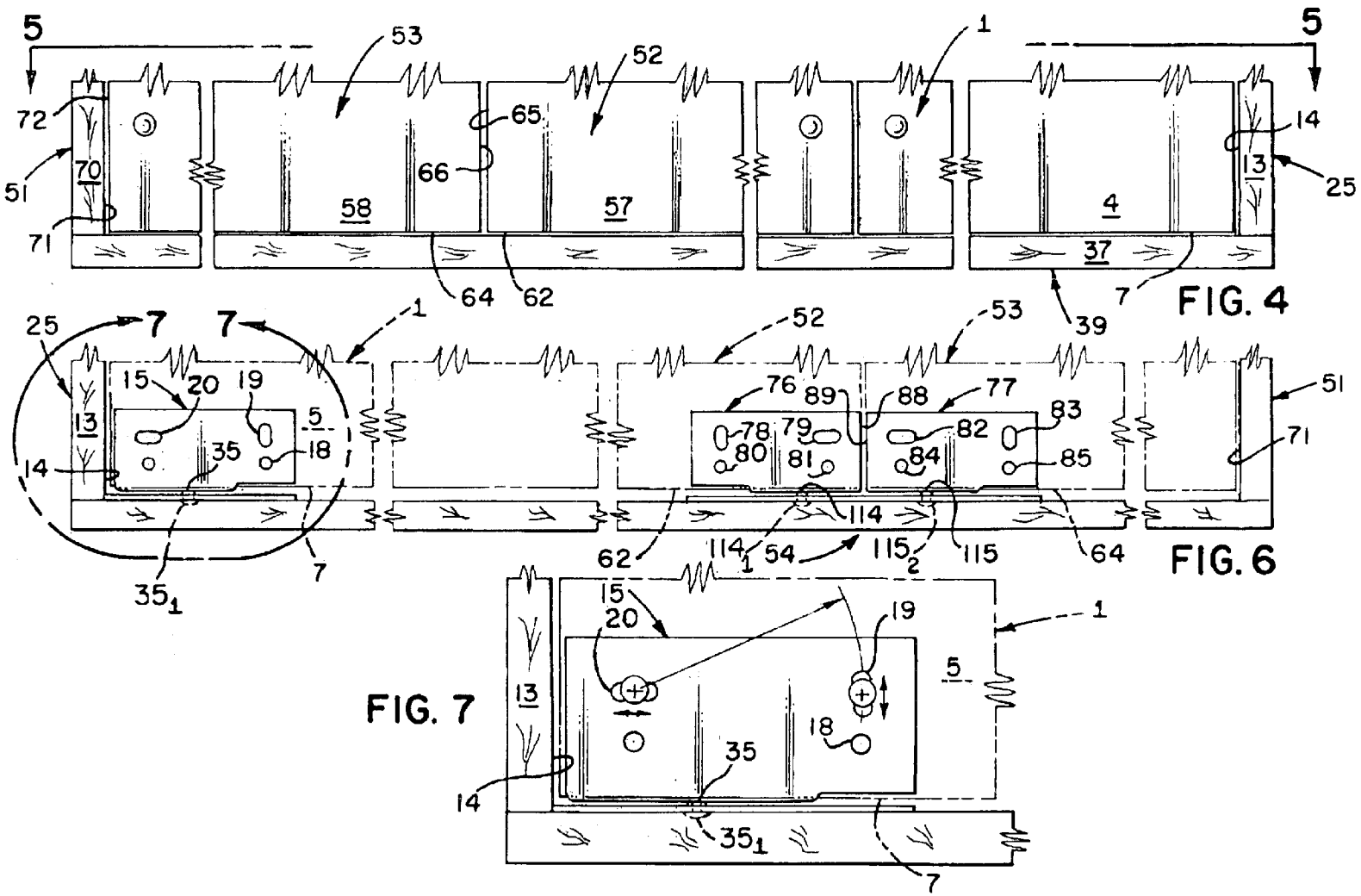
FIG. 4 is a front elevation view of a portion of the cabinet and portions of three doors shown in FIG. 1 taken generally along lines 4—4.
FIG. 6 is a rear elevation view of a portion of the cabinet shown in FIG. 5 taken generally along line 6—6 showing the hinges of the present elevation attached to the rear side of the cabinet doors.
FIG. 7 is an enlarged rear elevation view of a portion of the cabinet shown in FIG. 6 taken along line 7—7 showing in detail a portion of the hinge of the present invention and specifically illustrating the unique adjustability of the hinge to insure the proper alignment of the doors in the cabinet.

Another form of the invention is illustrated in FIGS. 1 and 3. Here, a double hinge is used for installing two side by side doors. Specifically, the present invention is a combination, with side by side second and third doors 52,53, a frame 2 having a bottom horizontal frame member 39 having a planar bottom frame member portion 103, a top horizontal frame member 40 having a planar top frame member portion 102, and a second vertical frame member 51 and a pair of concealed double hinges 54 for the second and third doors 52,53 mounted in edge to edge relationship and mounted for rotation 55,56 in opposite directions from closed to open positions, the second and third doors 52,53 having substantially planar front face portions 57,58 mounted in the same plane, and the second and third doors 52,53 having rear substantially planar face portions 59,60, and the second and third doors 52,53 having generally planar top 61,63 and bottom 62,64 edge face portions, and generally planar end face portions 65,66 closely spaced from and parallel to one another when the second and third doors 52,53 are in the closed positions and the planar door end face portions 65,66 intersect the planar door front face portions 57,58 forming front pivot corners 67,68 closely adjacent one another and the second and third doors 52,53 are mounted in the frame 2 defining a frame opening 69, and the top and bottom horizontal frame members 40,39 having planar front face portions 38,37 and the spaced second vertical frame member 51 having a substantially planar front face portion 70 and presenting a substantially planar side face portion 71 generally parallel and closely spaced from the adjacent planar third door end face portion 72 when the adjacent third door 53 is in the closed position.

The pairs of concealed double hinges 54 each consist of a pair of elongated door plate members 76,77 each formed with fastener openings 78–85 therethrough, and each having a lower edge 86,87 and a side edge 88,89 and a projection member 90,91 extending to a narrow distal end 92,93 from the lower edge 86,87 of each of the door plate members 76,77 at an angle 94,95 thereto and each door plate member 76,77 being connected to the respective upper and lower rear faces 59,60 of the second and third doors 52,53 adjacent the door front pivot corners 67,68.

Each double hinge 54 also include a hinge base plate member 101 connected to the respective planar top and bottom frame member portions 102,103 and formed with hinge base plate fastener openings 104–113 therethrough.

Second and third pivot means 114,115 are connected to the narrow distal ends 92,93 of the door plate projection members 90,91 and to the hinge base plate member 101.

The second and third pivot means 114,115 are located with respect to the elongated door plate members 76,77 and the hinge base plate member 101, and adjacent the substantially planar front face portions 57, 58 of the second and third doors 52,53 and adjacent the planar door end face portions 65,66 at a point sufficient distance from the adjoining planar end face portions 65,66 of the second and third doors 52,53 and from the planar front face portions 57. 58 of the second and third doors 52,53 so that the arcs 118,119 scribed by the front pivot corners 67,68 of each of the second and third doors 52,53 in edge to edge relationship do not intersect one another when the second and third doors 52,53 are pivoted about the second and third pivot means 114,115 from the closed to open positions, and the substantially planar front face portions 57, 58 of the second and third doors 52,53 when in the closed position are substantially parallel to the plane of the front faces 13,70 of the vertical frame members 25,51.

At least one of the fastener openings 79,82 in each of the elongated door plate members 76,77 is elongated in its vertical direction to permit independent adjustment of the respective second and third doors 52,53 in a vertical direction relative to the elongated door plate members 76,77.

At least two of the fastener openings 104,113 in the hinge base plate member 101 are elongated in a direction at right angles to the second and third doors 52,53 when the second and third doors 52,53 are in their closed position so as to permit front to rear adjustment of the location of the hinge base plate member 101 relative to the frame opening 69 defined by the planar front face portion 70 of the second vertical frame member 51, planar front face portion 37 of the bottom frame member 39, and planar front face portion 38 of the top horizontal frame member 40.

The method for installing the hinges 54 and the side by side second and third doors 52, 53 in the frame 2 is illustrated in FIGS. 1 and 3, Installation consists of creating a template 220 with indicia $104_1$–$107_1$, $110_1$–$113_1$ locating the hinge base plate fastener openings 104–113, indicia $114^1$, $115^1$ and locating the second and third pivot clearances $114_1$, $115_2$ in the hinge base plate member 101 and the center line 221 of the hinge base plate member 101 with respect to the planar front face portion 37 of the frame 2 and the center line 221 between the second and third doors 52, 53.

The template 220 is placed alternately on the top and bottom frame member portions 11, 12 of the frame 2 in alignment with the planar front face portion 37 of the frame 2 and the center line 221 between the doors 52, 53.

The next step is marking the location of the elongated fastener openings 104–113 and the pivot clearances $114_1$, $115_2$ alternately on the planar top and bottom frame member portions 11, 12.

The next step is forming depressions $114_2$, $115_2$ in the top and bottom frame member portions 11, 12 for clearance of the second and third pivot means 114, 115

The next step is placing the door plate members 76, 77 respectively on the substantially planar lower rear face portions 59, 60 of the second and third doors 52, 53 with the lower edges 86, 87 of the door plate members 76, 77 in registration with the bottom edge faces 62, 64 of the second and third doors 52, 53 and the side edges 88, 89 of the door plate members 76, 77 in registration with the substantially planar end face portions 65, 66 of the doors 52, 53, and then installing the other door plate members in like manner on the doors 52, 53 adjacent the top edge faces 61, 63 of the doors 52, 53.

The next step is setting the doors 52, 53 in the frame 2.

The final step is inserting fasteners respectively through the elongated fastener openings 104, 113 in the hinge base plate members 101 and into the marked locations of the elongated fastener openings in the planar top and bottom flange member portions 11, 12.

Figures 33, 34:
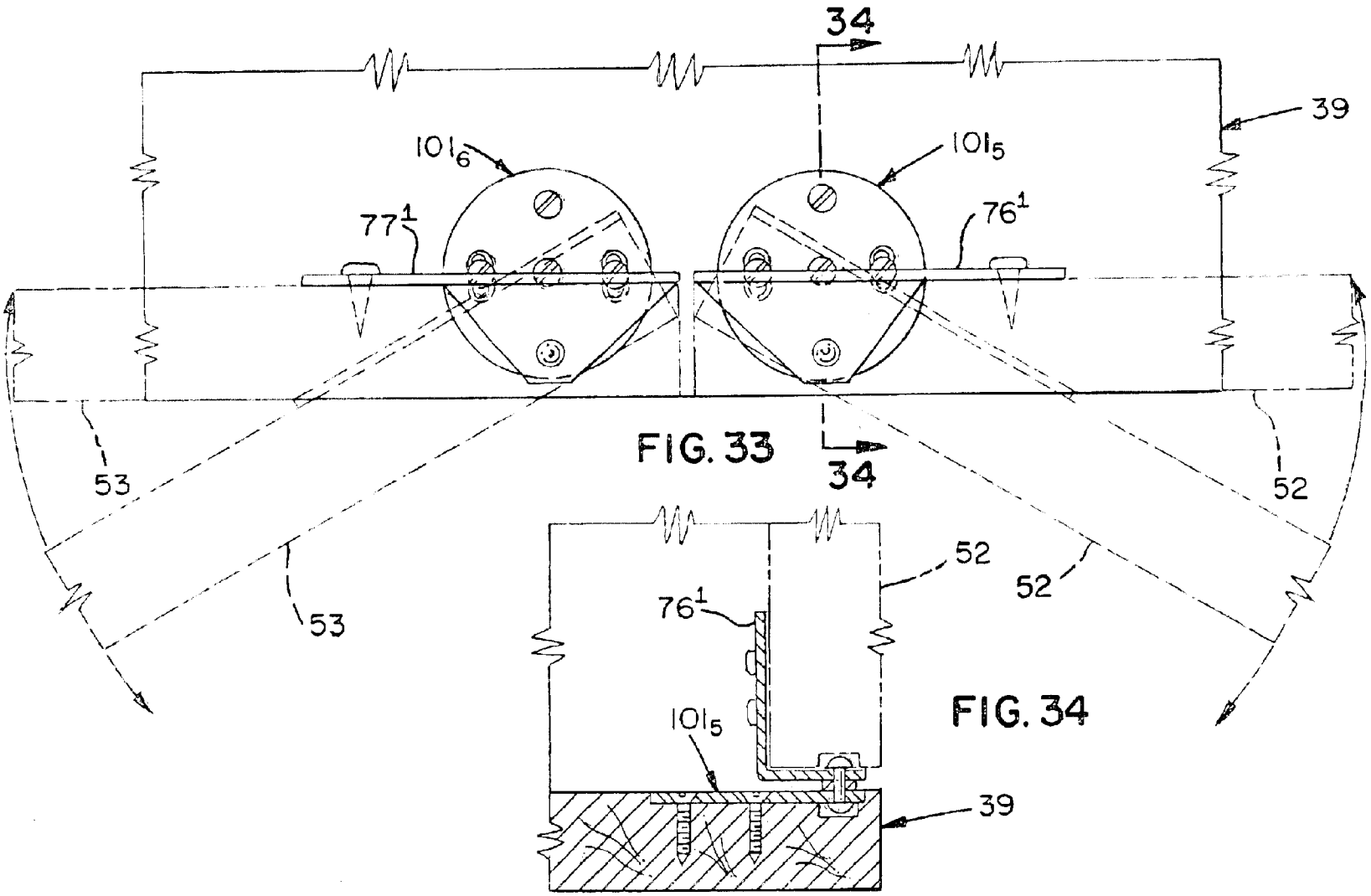
FIG. 33 is a top plan view of still another form of the invention of the present invention with two doors partially open shown in phantom line mounted on hinges which are mounted on a cabinet member.
FIG. 34 is a cross sectional view of the hinge shown in FIG. 33 taken along line 34—34.

Another form of the invention is illustrated in FIGS. 33 and 34. In this form of the invention the hinge base plate member is a pair of circle like members $101_5$ and $101_6$. The form of the invention shown in FIGS. 33 and 34 is identical to the form of the invention above described with reference to FIGS. 1 and 3 and is not further described for purposes of brevity. The doors in FIGS. 33 and 34 have been given the same numbers as in FIGS. 1 and 3. Hinge parts identical to hinge parts in FIG. 3 have been given identical numbers except for the addition of a superscript number. See for example elongated door plate member $76^1$ in FIG. 34.

A further description of the present invention illustrated in FIGS. 1 and 3 is a follows. The hinge base plate member 101 is formed with a front edge 121 and a pair of projection members 122,123 extending from the front edge 121 to narrow distal ends 124,125; and the second and third pivot means 114,115 are connected to the narrow distal ends 124,125 of the base plate projection members 122,123 and the narrow distal ends 92,93 of the door plate projection members 90,91.

FIGS. 10, 11, 12, 13, 20, 20A, 21, 22, and 23 illustrate still another form of the present invention in which a cabinet is shown having side by side stacked doors. In this form of the invention, the combination includes: a cabinet 130 having a frame 131, doors 132–139 hingedly mounted on the cabinet frame 131, and upper 54', lower 54", and intermediate 140 concealed hinges mounting the doors 132–139 on the cabinet frame 131.

The cabinet frame 131 includes: a bottom horizontal frame member 141 having an under side planar bottom frame member portion 142 and a planar front face portion formed with a pair of arcuate cut outs 180, 181, a top horizontal frame member 144 having a planar top frame member portion 145 and a planar front face portion 146, an intermediate frame member 147 located between the top 144 and bottom 141 frame members having a planar upper portion 148 and a planar front face portion 149 formed with a pair of arcuate cut outs 180', 181', first and second spaced vertical frame members 150, 151 supporting the bottom 141, top 144 and intermediate 147 frame members and each having planar front face portions 152, 153 and side face portions 154, 155.

The doors 132–139 include: upper side by side fourth 133 and fifth 134 doors, hingedly mounted on the top horizontal frame member 144 and the intermediate frame member 147, positioned in edge to edge relationship, and mounted for rotation in opposite directions from closed to open positions, the fourth 133 and fifth 134 doors having substantially planar front face portions 156, 157 positioned in the same plane in the closed position, and substantially planar rear face portions 158, 159 substantially parallel to the planar front face portions 156, 157, and the fourth 133 and fifth 134 doors having generally planar top 160 , 161 and bottom 162, 163 edge face portions, and generally planar end face portions 164, 165 closely spaced from and parallel to one another when the fourth 133 and fifth 134 doors are in the closed position and the planar door end face portions 164, 165 intersect the planar door front face portions 156, 157 respectively forming fourth and fifth door front pivot corners 166, 167 closely adjacent one another.

Also included in cabinet 10 are lower side by side sixth 137 and seventh 138 doors hingedly mounted on the intermediate frame member 147 and the bottom frame member 141 adjacent and below the fourth 133 and fifth 134 doors in edge to edge relationship and mounted for rotation in opposite directions from closed to open positions.

Sixth and seventh doors 137, 138 have substantially planar front face portions 168, 169, positioned to each other in the same plane in the closed position, and positioned in the same plane as the front face portions 156, 157 of the fourth and fifth doors 133, 134, and substantially planar rear face portions 170, 171 substantially parallel to the planar front face portions 168, 169.

The sixth and seventh doors 137, 138 have generally planar top 172, 173 and bottom 174, 175 edge face portions, and generally planar end face portions 176, 177 closely spaced from and parallel to one another when the sixth and seventh doors 137, 138 are in the closed position.

Planar door end face portions 176, 177 of the sixth and seventh doors 137, 138 intersect the planar door front face portions 168, 169 respectively forming sixth and seventh front pivot corners 178, 179 closely adjacent one another.

The upper concealed hinges 54' include: a pair of elongated door plate members 76', 77' each formed with fastener openings 78'-85' therethrough, and each have a' projection edge 86', 87' and a side edge 88', 89' and a projection member 90', 91' extending to a narrow distal end 92', 93' from the projection edge 86', 87' of each of the door plate members 76', 77' at an angle thereto and each door plate member 76', 77' being connected to the respective upper rear face portions 158, 159 of the fourth and fifth doors 133, 134 adjacent the respective fourth and fifth door front pivot corners 166, 167.

Figures 5, 5A:
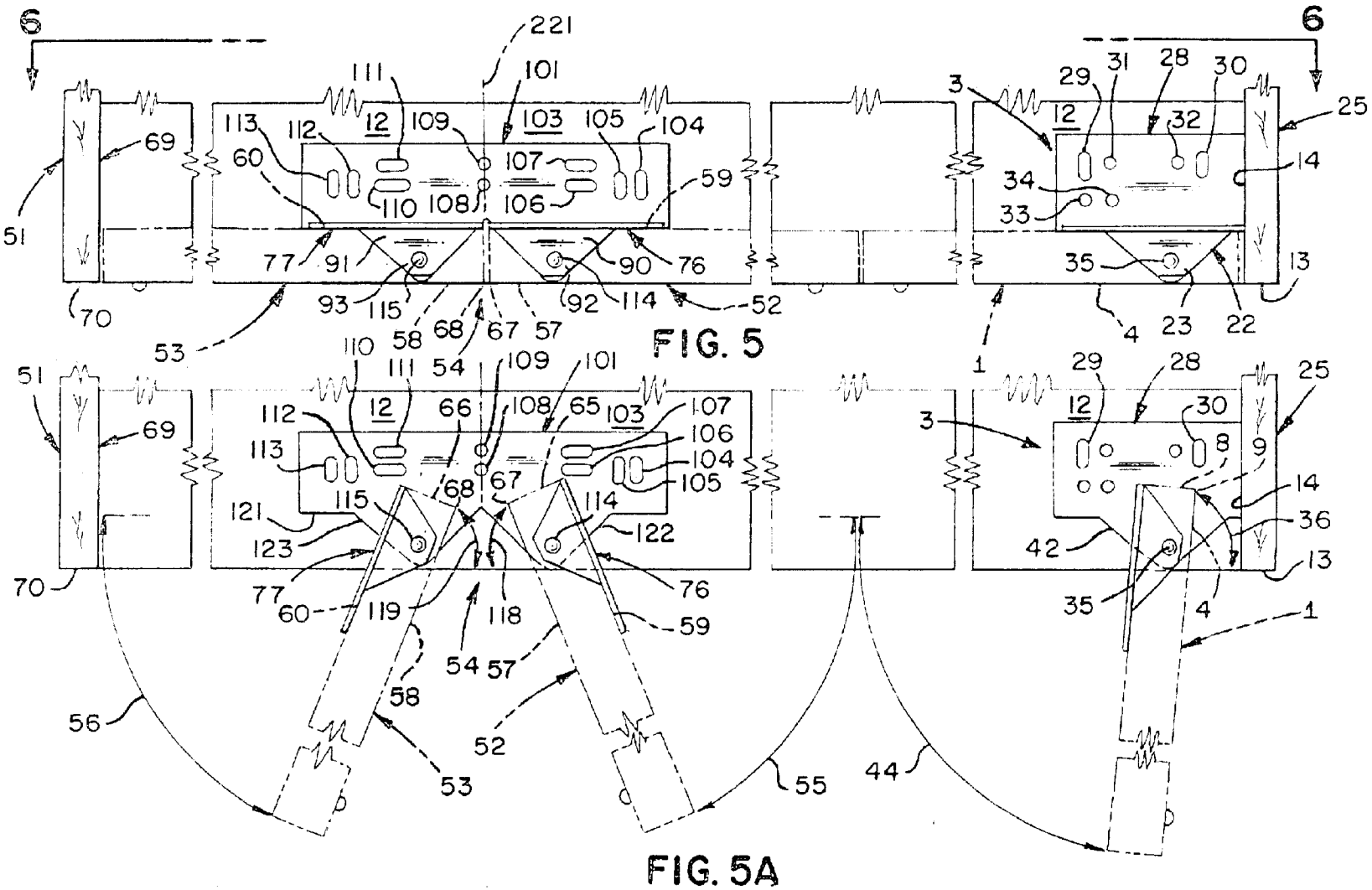
FIG. 5 is a top plan view of a portion of the cabinet shown in FIG. 4 taken generally in the direction of line 5—5 with the doors in the closed position. Portions of the cabinet and doors are shown in phantom line. The single door hinge illustrated in FIG. 2 is shown in reduced scale at the right side of FIGS. 5 and 5A.
FIG. 5A is view similar to FIG. 5 with the doors swung to an open position. Portions of the cabinet and doors are shown in phantom line. The arc taken by the doors is shown by the double headed arrows.
Figure 8:
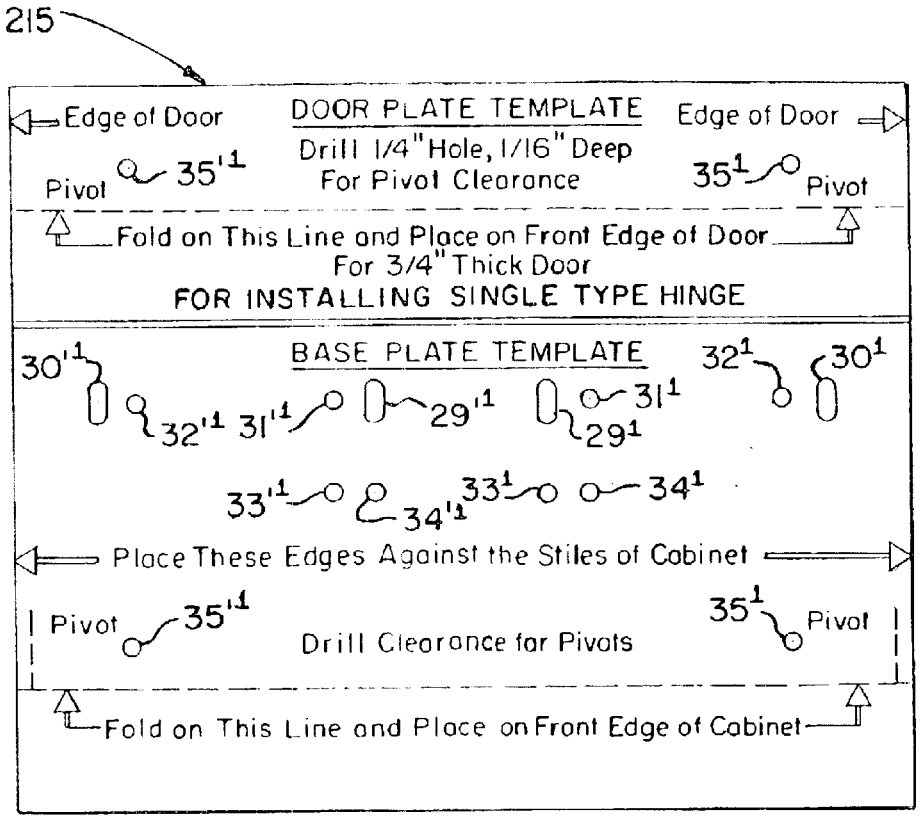
FIG. 8 is a plan view of a template used to install the hinge illustrated in FIG. 2.
Figure 20:
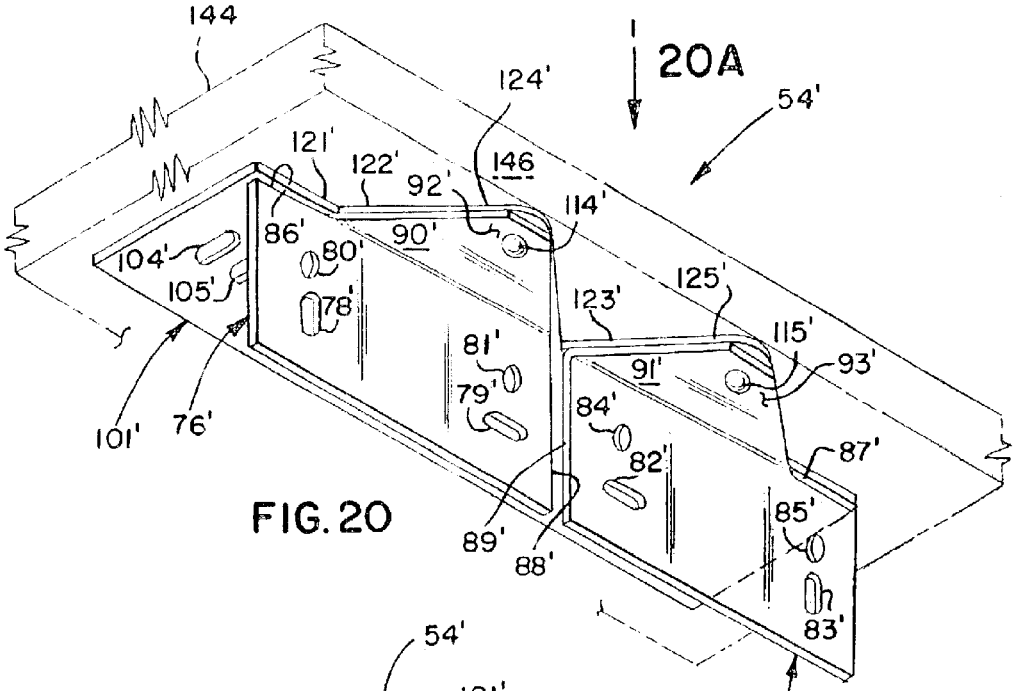
FIG. 20 is an enlarged scale perspective view of another form of hinge which is located in the vicinity of line 20—20 in FIG. 10 looking upwardly at an angle at the underside of the top horizontal frame member. Only a portion of the top horizontal frame member of the cabinet is shown in phantom line. The doors have been removed for purposes of clarity.
Figure 20A:
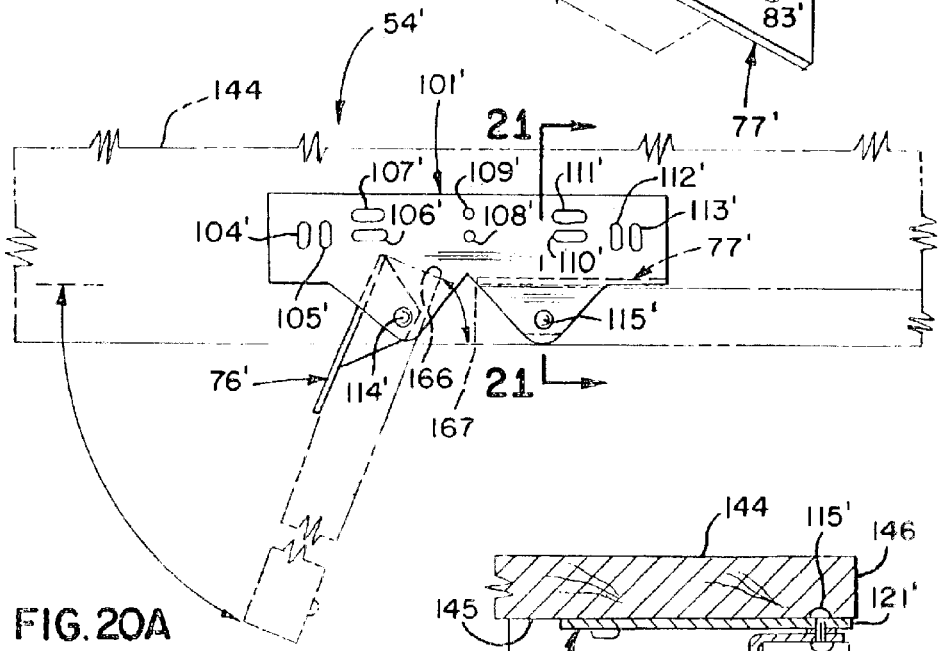
FIG. 20A is a top plan view of the upper concealed hinges shown in FIG. 20 taken in the direction of arrow 20A. The hinges are attached to the underside of the top horizontal frame member. The doors are shown in phantom line. The door on the left as shown in the drawing has been swung to the open position along the arc of the double arrow.
Figure 21:
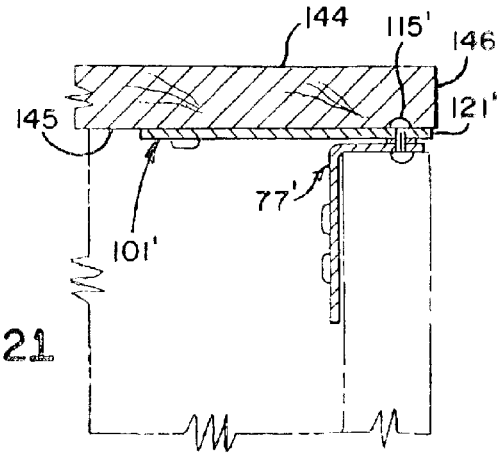
FIG. 21 is a cross sectional view on an enlarged scale taken along line 21—21 in FIG. 20A.

Hinge base plate member 101' as shown in FIG. 20, is formed with fastener openings in the same number, configuration, and placement as shown in FIG. 5A. For purposes of brevity and clarity, only openings 104' and 105' are shown.

Hinge base plate member 101' is connected to the planar top frame member portion 145 and is formed with a front edge 121' and a pair of spaced projection members 122', 123' extending from the front edge 121' to narrow distal ends 124', 125'.

Second and third pivot means 114', 115' are connected to the narrow distal ends 92', 93' of the door plate projection members 90', 91' and to the narrow distal ends 124', 125' of the projection members 122', 123' of the hinge base plate member 101'.

The second and third pivot means 114', 115' are located with respect to the respective elongated door plate members 76', 77' and the hinge base plate member 101'; and adjacent the substantially planar front face portions 156, 157 of the fourth and fifth doors 133, 134 and adjacent the planar door end face portions 164, 165 at a point sufficient distance from the adjoining planar end face portions of the fourth and fifth doors 133, 134 and from the planar front face portions 156, 157 of the fourth and fifth doors 133, 134, so that the arcs, (no numbers), scribed by the fourth and fifth door front pivot corners 166, 167 do not intersect one another when the fourth and fifth doors 133, 134 are pivoted about the second and third pivot means 114', 115 from the closed to open positions, and the substantially planar front face portions 156, 157 of the fourth and fifth doors 133, 134 when in the closed position are substantially parallel to the plane of the front faces 152, 153 of the first and second vertical frame members 150, 151.

At least one of the fastener openings 78', 83' in each of the elongated door plate members 76', 77' is elongated in its vertical direction to permit independent adjustment of the respective fourth and fifth doors 133, 134 in a vertical direction relative to the elongated door plate members 76', 77'.

At least two of the fastener openings 104' in the hinge base plate member 101' are elongated in a direction at right angles to the fourth and fifth doors 133, 134 when the fourth and fifth doors 133, 134 are in their closed position so as to permit front to rear adjustment of the location of the hinge base plate member 101' relative to the planar front face portions 156, 157 of the first and second vertical frame members 150, 151, and planar front face portions 143, 146 of the bottom and top horizontal frame members 141, 144.

The lower concealed hinges 54" include: a pair of elongated door plate members 76", 77" each formed with fastener openings 78"–85" therethrough, and each having a projection edge 86", 87" and a side edge 88', 89" and a projection member 90", 91" extending to a narrow distal end 92", 93" from the projection edge 86", 87" of each of the door plate members 76", 77" at an angle thereto.

Each door plate member 76", 77" is connected to the respective lower rear face portions 170, 171 of the sixth and seventh doors 137, 138 adjacent the respective sixth and seventh door front pivot corners 178, 179;

A hinge base plate member 101", formed with fastener openings 104" 113", is connected to the under side planar bottom frame member portion 142 of the bottom horizontal frame member 141 and formed with a front edge 121' and a pair of spaced projection members 123", 124" extending from the front edge 121" to narrow distal ends 124", 125".

The front edge 121" of the hinge base plate member 101' is positioned generally flush with the planar front face portion 143 of the bottom horizontal frame member 141 as shown in FIG. 20, formed with fastener openings in the same number, configuration, and placement as shown in FIG. 5A. For purposes of brevity and clarity, only openings 104" and 105" are shown.

Second and third pivot means 114, 115" are connected to the narrow distal ends 92", 93" of the door plate projection members 90", 91" and to the narrow distal ends 124", 125" of the projection members 122", 123" of the hinge base plate member 101".

The second and third pivot means 114", 115" are located with respect to the respective elongated door plate members 76", 77" and the hinge base plate member 101"; and adjacent the substantially planar front face portions 168, 169 of the sixth and seventh doors 137, 138 and adjacent the planar door end face portions 176, 177 at a point sufficient distance from the adjoining planar end face portions 176, 177 of the sixth and seventh doors 137, 138 and from the planar front face portion 176, 177 of the sixth and seventh doors 137, 138 so that the arcs, not shown, scribed by the sixth and seventh door front pivot corners 178, 179 do not intersect one another.

The arcs (see double arrow 182 in FIG. 23) scribed by the edges 88", 89" of the door plate members 76", 77" do not intersect the pair of arcuate cut outs 180, 181 in the planar front face portion 149 of the bottom horizontal frame member when the sixth and seventh doors 137, 138 are pivoted about the second and third pivot means 114", 115" from the closed to open positions.

The substantially planar front face portions 168, 169 of the sixth and seventh doors 137, 138 when in the closed position are substantially parallel to the plane of the planar front faces 168, 169 of the fourth and fifth doors 156, 157.

At least one of the fastener openings 78", 83" in each of the elongated door plate members 76", 77" is elongated in its vertical direction to permit independent adjustment of the respective sixth and seventh doors 137, 138 in a vertical direction relative to the elongated door plate members 76", 77".

At least two of the fastener openings 106", 112" in the hinge base plate member 101" are elongated in a direction at right angles to the sixth and seventh doors 137", 138" when the sixth and seventh doors 137, 138 are in their closed position so as to permit front to rear adjustment of the location of the hinge base plate member 101" relative to the planar front face portion 143 of the bottom horizontal frame member 141; and planar front face portions 143, 146 of the bottom and top horizontal frame members 141, 144.

The intermediate concealed hinges 140 include: a pair of upper elongated door plate members 76"', 77"' each formed with fastener openings 78"'-85"' therethrough, and each having a projection edge 86"', 87"' and a side edge 88"', 89"' and a projection member 90"', 91"' extending to a narrow distal end 92"', 93"' from the projection edge 86"', 87"' of each of the upper door plate members 76"', 77"' at an angle thereto.

Each upper door plate member 76"', 77"' is connected to the respective lower rear face portions 158, 159 of the fourth and fifth doors 133, 134 adjacent the respective fourth and fifth door front pivot corners 67, 68.

A hinge base plate member 101"' is formed with fastener openings 104"'-113"', and connected to the planar upper portion 148 of the intermediate frame member 147.

Hinge base plate member 101"' is formed with a front edge 121"' and a pair of spaced projection members 122"', 123"' extending from the front edge 121 "' to narrow distal ends 124"', 125"'.

The front edge 121"' of the hinge base plate member 101"' is positioned generally flush with the planar front face portion 149 of the intermediate frame member 147.

Second and third pivot means 114"', 115"' are connected to the narrow distal ends 124"', 125"' of the door plate projection members 90"', 91 "' of the upper elongated door plate members 76"', 97"' and to the narrow distal ends 124"', 125"' of the projection members of the hinge base plate member 101"'.

The second and third pivot means 114"', 115"' are located with respect to the respective elongated upper door plate members 76"', 77"' and the hinge base plate member 101"'; and adjacent the substantially planar lower front face portions 156, 157 of the fourth and fifth doors 133, 134 and adjacent the planar lower door end face portions 164, 165 at a point sufficient distance from the adjoining planar lower end face portions 164, 165 of the fourth and fifth doors 133, 134 and from the planar lower front face portions 156, 157 of the fourth and fifth doors 133, 134 so that the arcs scribed by the fourth and fifth lower door front pivot corners 166, 167 do not intersect one another when the fourth and fifth doors 133, 134 are pivoted about the third and second pivot means 115''', 114''' from the closed to open positions.

The substantially planar front face portions 156, 157 of the fourth and fifth doors 133, 134 when in the closed position are substantially parallel to the plane of the front faces 152, 153 of the first and second vertical frame members 150, 151.

At least one of the fastener openings 78''', 83''' in each of the elongated upper door plate members 76''', 77''' is elongated in its vertical direction to permit independent adjustment of the respective fifth and fourth doors 134, 133 in a vertical direction relative to the elongated door plate members 76''', 77'''.

At least two of the fastener openings 104''', 113''' in the hinge base plate member 101''' are elongated in a direction at right angles to the fifth and fourth doors 134, 133 when the fifth and fourth doors 134, 133 are in their closed position so as to permit front to rear adjustment of the location of the hinge base plate member 101''' relative to the planar front face portion 153, 152 of the first and second vertical frame members 151, 150, and planar front face portions 143,146 of the bottom and top horizontal frame members 141,144.

A pair of elongated lower door plate members 76'''', 77'''' each formed with fastener openings 78'''', 79'''', 80'''', 82'''', 83'''', 85'''' therethrough, and each having a projection edge 86'''', 87'''' and a side edge 88'''', 89'''' and a projection member 90'''', 91'''' extending to a narrow distal end 92'''', 93'''' from the projection edge 86'''', 87'''' of each of the lower door plate members at an angle thereto and each lower door plate member 76'''', 77'''' are connected to the respective upper rear face portions 171, 170 of the seventh and sixth doors 138, 137 adjacent the respective sixth and seventh door front pivot corners 179, 178.

The door plate projection members 90'''', 91'''' of the lower elongated door plate members 76'''', 77'''' are connected to the second and third pivot means 114'''', 115''''.

The second and third pivot means 114'', 115'''' are located with respect to the respective elongated lower door plate members 76'''', 77'''' and the hinge base plate member 101'''; and adjacent the substantially planar upper front face portions 169, 168 of the seventh and sixth doors 138, 137 and adjacent the planar upper door end face portions 177, 176 at a point sufficient distance from the adjoining planar upper end face portions 177, 176 of the seventh and sixth doors 138, 137 and from the planar lower front face portion 169,168 of the seventh and sixth doors 138, 137 so that the arcs scribed by the seventh and sixth upper door front pivot corners 179, 178 do not intersect one another and the arcs (not indicated by a number) scribed by the edges 88'''', 89'''' of the door plate members 76''', 77''' do not intersect the pair of arcuate cut outs 180', 181' in the planar front face portion 149 of the intermediate frame member 147, when the seventh and sixth doors 138, 137 are pivoted about the second and third pivot means 114'''', 115'''' from the closed to open positions.

The substantially planar front face portions 169, 168 of the seventh and sixth doors 138, 137 when in the closed position are substantially parallel to the plane of the front faces 153, 152 of the second and first vertical frame members 151, 152.

At least one of the fastener openings 78'''', 83'''' in each of the elongated lower door plate members 76'''', 77'' is elongated in its vertical direction to permit independent adjustment of the respective seventh and sixth doors 138, 137 in a vertical direction relative to the elongated lower door plate members 76'''', 77''''.

Figures 10, 11:
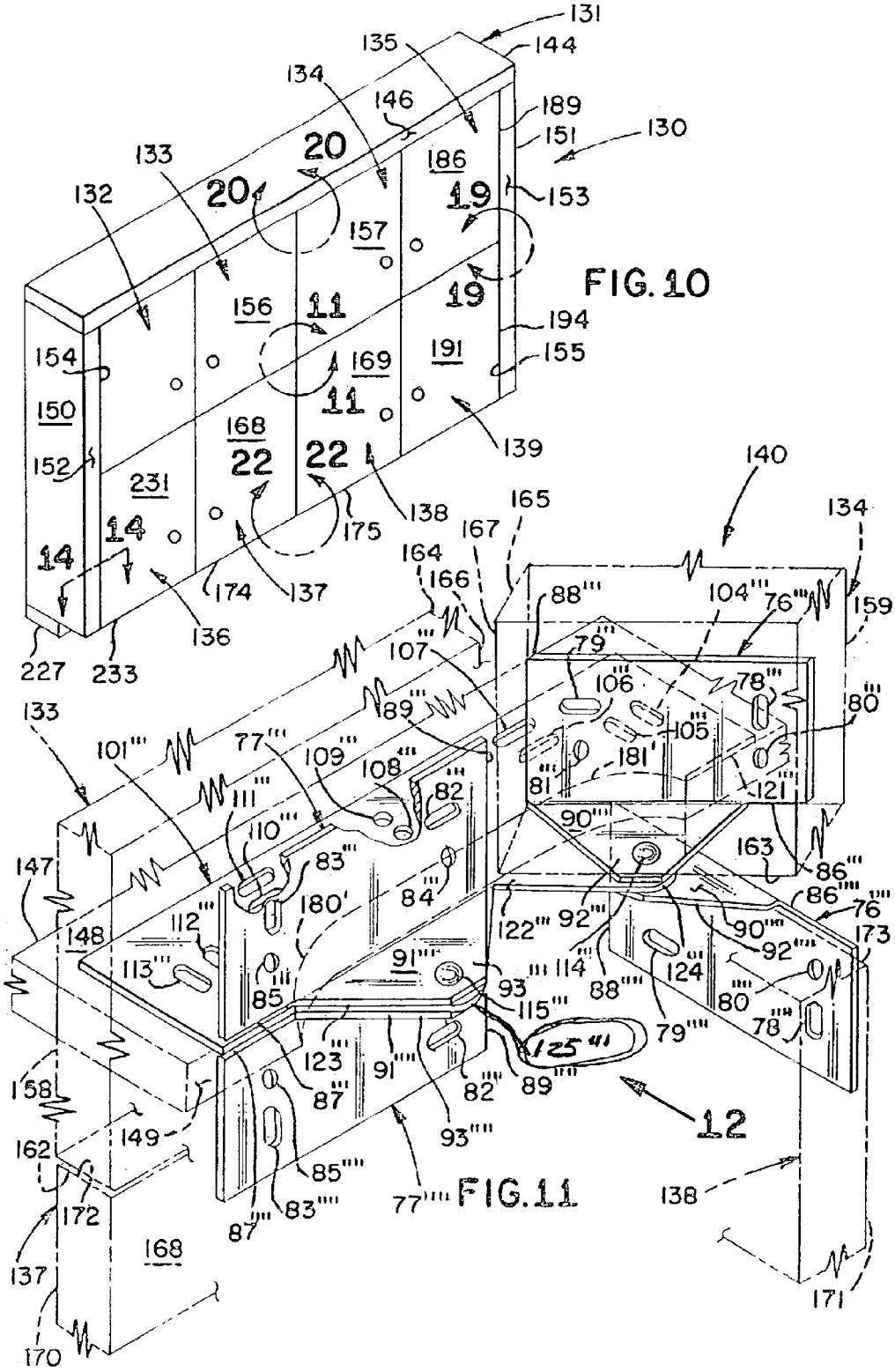
FIG. 10 is a perspective view of another type of cabinet with another form of hinge of the present invention installed.
FIG. 11 is a perspective enlarged view of another form of hinge of the present invention installed in the cabinet of FIG. 10 and located along the line 11—11. Portions of the cabinet and doors are shown in phantom line. The two doors on the left side of the drawing are shown in the closed position while the upper door on the right side is shown in the partially open position and the lower door on the right side is shown in the fully open position. A portion of a cabinet shelf member is shown in phantom. The curved phantom line indicates a portion of the front edge of the shelf cut out to permit free opening of the lower doors.
Figure 12:
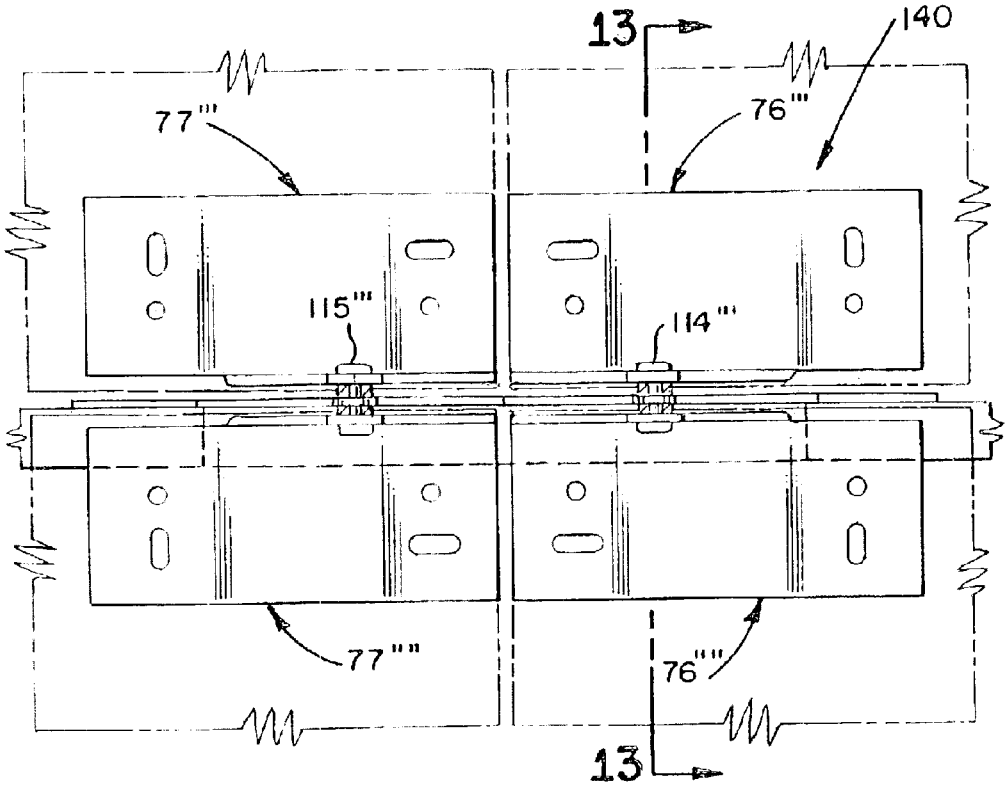
FIG. 12 is a front elevation view of the hinges shown in FIG. 11 taken in the direction of arrow 12. The doors, partially shown in phantom, are in the closed position.
Figure 13:
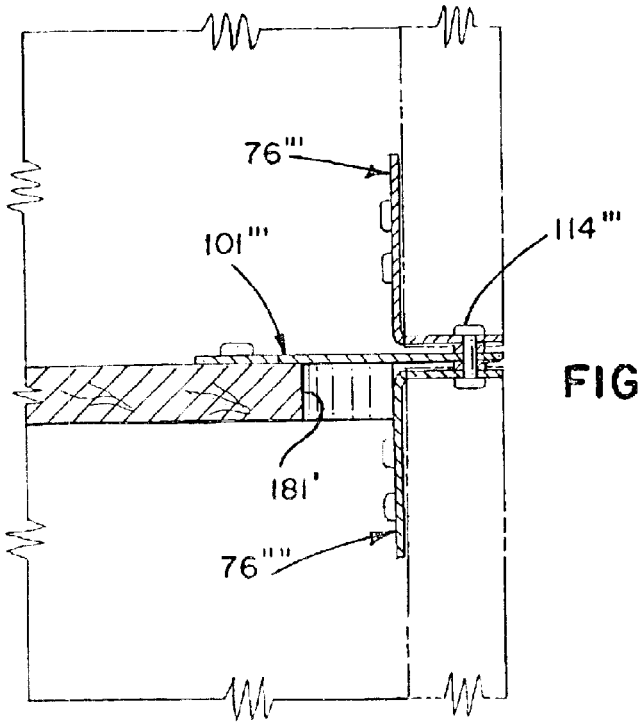
FIG. 13 is a cross sectional view taken along line 13—13 of FIG. 12. Portions of the doors and cabinet are shown in phantom line. A portion of the shelf to which the hinge is attached is shown in solid line. Note the cut out portion in the shelf to permit the lower door to open freely.

As shown in FIG. 10, doors 137 and 138 are constructed so that their planar bottom edge face portions 174, and 175 are flush with the under side planar bottom frame member portion 142 of cabinet 10, and doors 137 and 138 overlie the planar front face portion of bottom horizontal frame member 141. This construction is known in the trade as a "flush overlay". This construction permits doors 137 and 138 to be raised above the floor with a toe board 227 providing a "to kick space below the cabinet 130.

Figure 24:
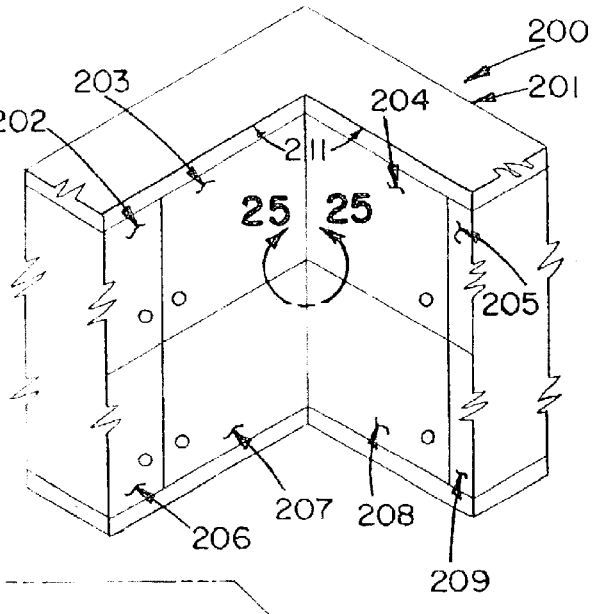
FIG. 24 is a perspective view on a reduced scale of a corner cabinet.
Figure 26:
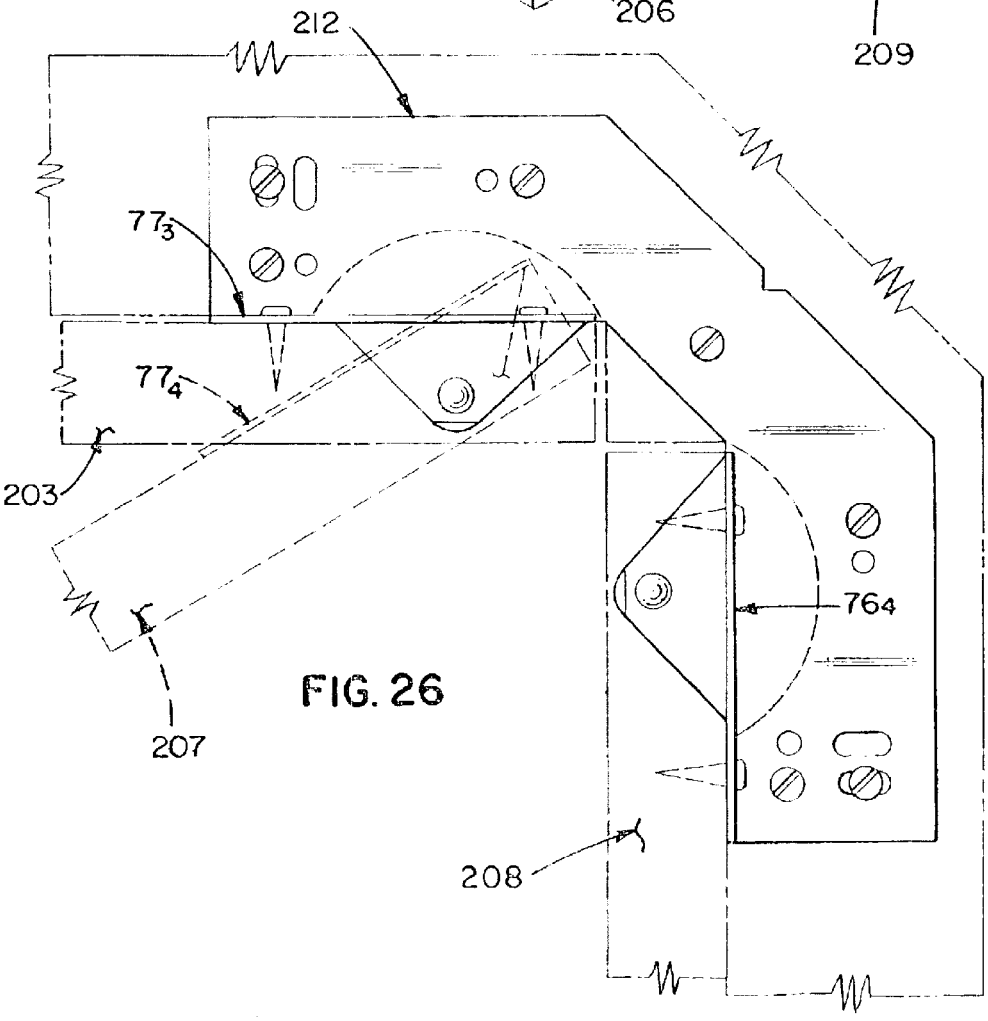
FIG. 26 is a top plan view of the hinge shown in FIG. 25. The door on the left side of the drawing shown in phantom line is shown in the partly open position while the door on the right side shown in phantom line is shown in the closed position.
Figure 25:
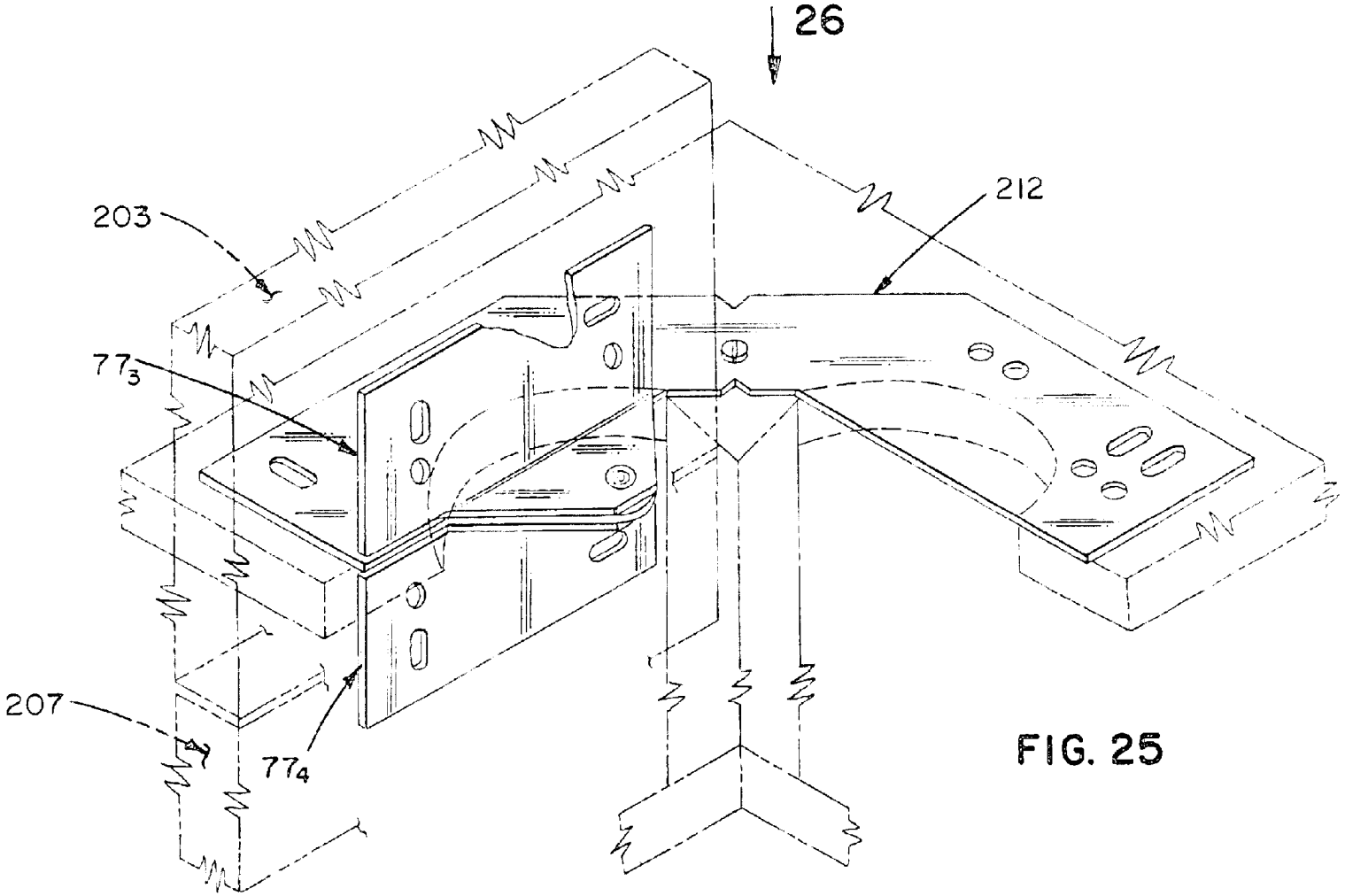
FIG. 25 is a perspective view on an enlarged scale of another form of the hinges of the present invention taken along line 25—25 in FIG. 24. The portion of the hinge in the right side of the hinge has been removed to more clearly show the cut that must be made in the cabinet shelf to accommodate the hinge and permit opening of the doors.

Still another variation of the present invention is illustrated in FIGS. 24–26. In this combination, a cabinet 200 having a frame 201, doors 202–209, including upper side-by-side doors 203, 204 and lower side-by-side doors 207, 208 are hingedly mounted on the cabinet frame 201 and upper (not shown), lower (not shown) and intermediate concealed hinges 210 mounting the doors 202–209 on the cabinet frame 201 are illustrated.

The corner cabinet 200 further includes: a cabinet frame 201 formed with an inside 90° corner 211.

The upper and lower side by side doors 203, 204, 207, 208 are mounted at an angle of 90° to one another on the upper concealed hinges (not shown), the lower concealed hinges (not shown), and the intermediate concealed hinges 210.

The hinge base plates such as intermediate hinge base plate 212 of the upper (not shown), lower (not shown) and intermediate concealed hinges 210 are formed to mount the respective door plate members, such as upper elongated door plate members $76_3$ (not shown), $77_3$ and lower door plate members $76_4$, $77_4$, at an angle to each other.

Figure 19:
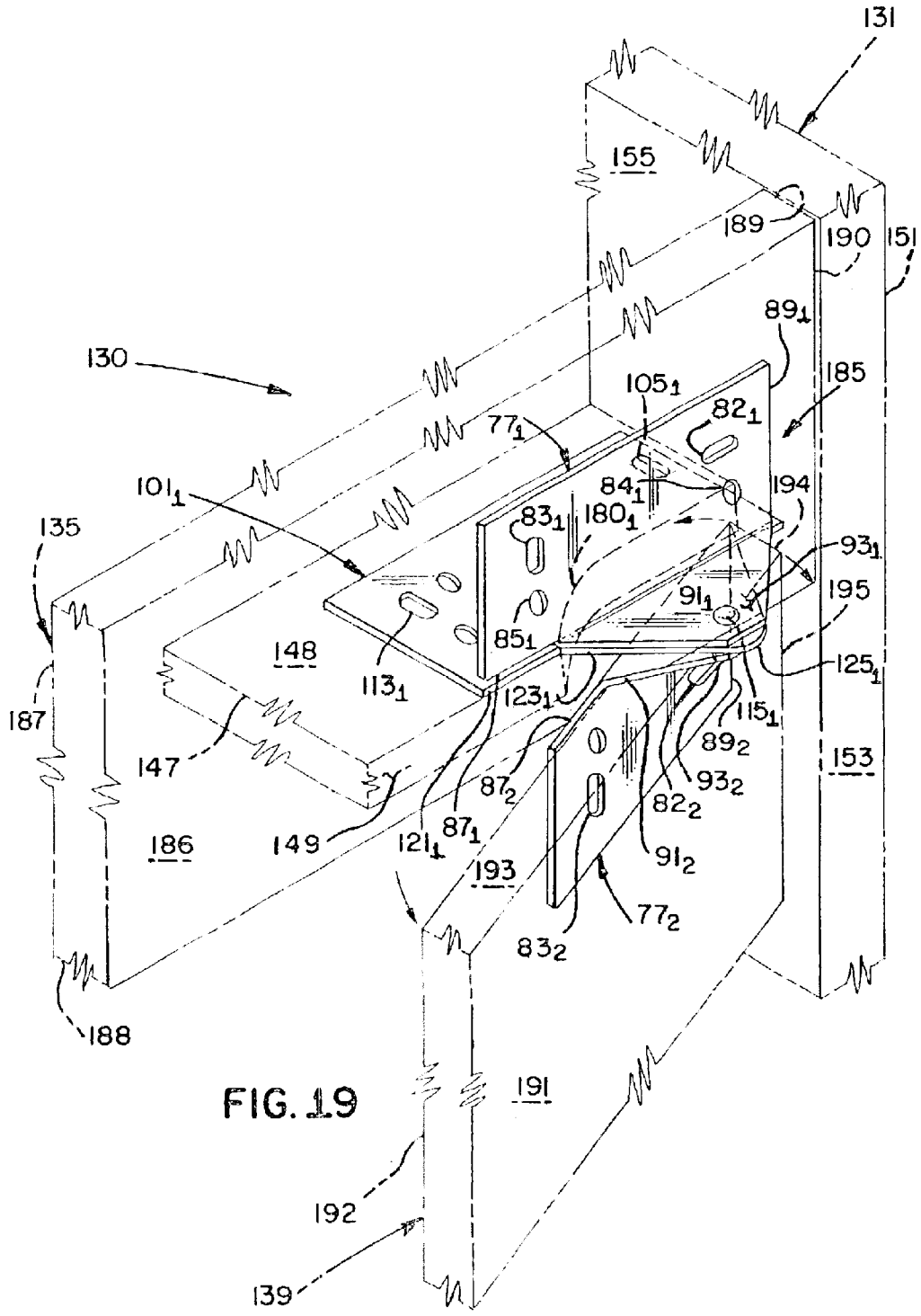
FIG. 19 is an enlarged scale perspective of another hinge of the present invention taken in the vicinity of line 19—19 in FIG. 10.

The cabinet illustrated in FIGS. 10 and 19 illustrate a combination of a cabinet 130 having a frame 131, at least two doors 135, 139 mounted one above the other and hingedly mounted on the cabinet frame 131, and intermediate concealed hinges 185 mounting the doors 135, 139 on the cabinet frame 131.

The cabinet frame 131 includes: a top frame member 144, a bottom frame member 141, an intermediate frame member 147 located between the top and bottom frame members 141, 141 having a planar upper portion 148 and a planar front face portion 149 formed with an arcuate cut out $180_1$.

A vertical frame member 151 supports the bottom, top and intermediate frame members 141, 144, 147 and has a planar front face portion 153 and a planar side face portion 155.

The doors 135, 139 include: an upper door 135, hingedly mounted on the top frame member 144 and the intermediate frame member 147, and are mounted for rotation from closed to open positions.

Doors 135, 139 have a substantially planar front face portion 186 and a substantially planar rear face portion 187 substantially parallel to the planar front face portion 186.

The upper door 135 has a generally planar bottom edge face portion 188, and a generally planar end face portion 189 closely spaced from and parallel to the planar side face portion 155 of the vertical frame member 151 when the door is in the closed position.

The planar door end face portion 189 intersects the planar door front face portion 186 forming a front pivot corner closely adjacent the vertical frame member 151.

Lower door 139 is hingedly mounted on the intermediate frame member 147 and the bottom frame member 141 adjacent and below the upper door 135 in edge to edge relationship and is mounted for rotation from closed to open positions.

The lower door 139 has a substantially planar front face portion 191, positioned in the same plane as the front face portion 186 of the upper door 135, and a substantially planar rear face portion 192 substantially parallel to the planar front face portion 191.

The lower door 139 has a generally planar top edge face portion 193, and a generally planar end face portion 194 closely spaced from and parallel to the planar side face portion 155 of the vertical frame member 151 when the lower door 139 is in the closed position and the planar door end face portion 194 of the lower door 139 intersects the planar door front face portion 191 forming a front pivot corner 195 closely adjacent the vertical frame member 151.

The intermediate concealed hinges 185 include: an upper elongated door plate member $\mathbf{77}_1$ formed with fastener openings $\mathbf{82}_1$–$\mathbf{85}_1$ therethrough, and have a projection edge $\mathbf{87}_1$ and a side edge $\mathbf{89}_1$, and a projection member $\mathbf{91}_1$ extending to a narrow distal end $\mathbf{93}_1$ from the projection edge $\mathbf{87}_1$ of the upper door plate member $\mathbf{77}_1$ at an angle thereto and the upper door plate member 77 being connected to the lower rear face portion 187 of the upper door 135 adjacent the upper door front pivot corner 190.

Hinge base plate member $\mathbf{101}_1$, formed with fastener openings $\mathbf{105}_1$, $\mathbf{113}_1$, is connected to the planar upper portion 148 of the intermediate frame member 147 and formed with a front edge $\mathbf{121}_1$ and a projection member $\mathbf{123}_1$ extending from the front edge 121, to a narrow distal end $\mathbf{125}_1$.

The front edge $\mathbf{121}_1$ of the hinge base plate member $\mathbf{101}_1$ is positioned generally flush with the planar front face portion 149 of the intermediate frame member 147.

A pivot means $\mathbf{115}_1$ is connected to the narrow distal end of the door plate projection member $\mathbf{93}_1$ and the narrow distal end $\mathbf{125}_1$ of the projection member $\mathbf{123}_1$ of the hinge base plate member $\mathbf{101}_1$.

The pivot means $\mathbf{115}_1$ is located with respect to the elongated upper door plate member $\mathbf{77}_1$ and the hinge base plate member $\mathbf{101}_1$; and adjacent the substantially planar lower front face portions 186, 191 of the upper and lower doors 135, 139 and adjacent the planar upper and lower door end face portions 189, 141 at a point sufficient distance from the adjoining planar lower end face portions 189, 194 of the upper and lower doors 135, 139 and from the planar lower front face portions 186, 191 of the upper and lower doors 135, 139 so that the arcs scribed by the upper and lower door front pivot corners 190, 195 do not intersect the planar side face portion 155 of the vertical frame member 151 when the doors 135, 139 are pivoted about the pivot means $\mathbf{115}_1$ from the closed to open positions, and the substantially planar front face portions 186, 191 of the upper and lower doors 135. 139 when in the closed position are substantially parallel to the plane of the front face 153 of the vertical frame member.

At least one of the fastener openings $\mathbf{83}_1$ in the elongated upper door plate member $\mathbf{77}_1$ is elongated in its vertical direction to permit independent adjustment of the upper door 135 in a vertical direction relative to the elongated upper door plate member $\mathbf{77}_1$.

At least two of the fastener openings $\mathbf{105}_1$–$\mathbf{113}_1$ in the hinge base plate member 101, are elongated in a direction at right angles to the upper and lower doors 135, 139 when the upper and lower doors 135, 139 are in their closed position so as to permit front to rear adjustment of the location of the hinge base plate member $\mathbf{101}_1$ relative to the planar front face portion 153 of the vertical frame member 151.

An elongated lower door plate member $\mathbf{77}_2$ is formed with fastener openings $\mathbf{82}_2$, $\mathbf{83}_2$ therethrough having a projection edge $\mathbf{87}_2$ and a side edge $\mathbf{89}_2$ and a projection member $\mathbf{91}_2$ extending to a narrow distal end $\mathbf{93}_2$ from the projection edge $\mathbf{87}_2$ of the lower door plate member $\mathbf{77}_2$ at an angle thereto and the lower door plate member $\mathbf{77}_2$ is connected to the upper rear face portion 192 of the lower door 139 adjacent the lower door front pivot corner 195.

The door plate projection member $\mathbf{91}_2$ of the lower elongated door plate member $\mathbf{77}_2$ is connected to the pivot means $\mathbf{115}_1$.

The pivot means $\mathbf{115}_1$ is located with respect to the elongated lower door plate member $\mathbf{77}_2$ and the hinge base plate member $\mathbf{101}_1$; and adjacent the substantially planar upper front face portion 191 of the lower door 139 and adjacent the planar lower door end face portion 194 at a point sufficient distance from the adjoining planar upper end face portion 194 of the lower door 139 and from the planar lower front face portion 191 of the lower door 139 so that the arc scribed by the lower door front pivot corner 195 does not intersect the planar side face portion 153 of the vertical frame member 151 and does not intersect the arcuate cut out 180 in the planar front face portion 149 of the intermediate frame member 147, when the lower door 139 is pivoted about the pivot means $\mathbf{115}_1$ from the closed to open positions, and the substantially planar front face portions 186, 191 of the upper and lower doors 135, 139 when in the closed position are substantially parallel to each other and to the plane of the front face 153 of the vertical frame member 151.

At least one of the fastener openings $\mathbf{83}_2$ in the elongated lower door plate member 77 is elongated in its vertical direction to permit independent adjustment of the lower door 139 in a vertical direction relative to the elongated lower door plate member $\mathbf{77}_2$.

Figure 29:
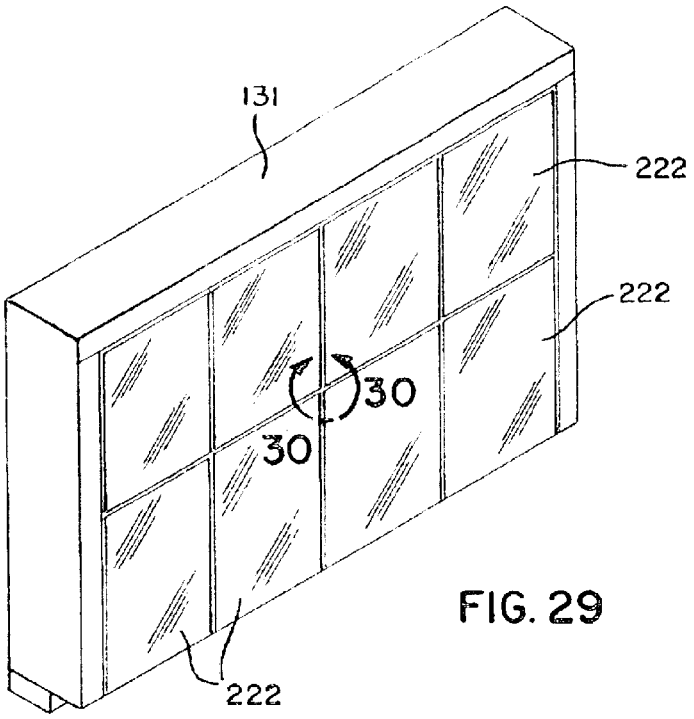
FIG. 29 is a reduced scale perspective view of still another form of cabinet. This cabinet is similar to the cabinet shown in FIG. 10 except that the cabinet doors have been faced with mirrors or other decorative panels.
Figure 30:
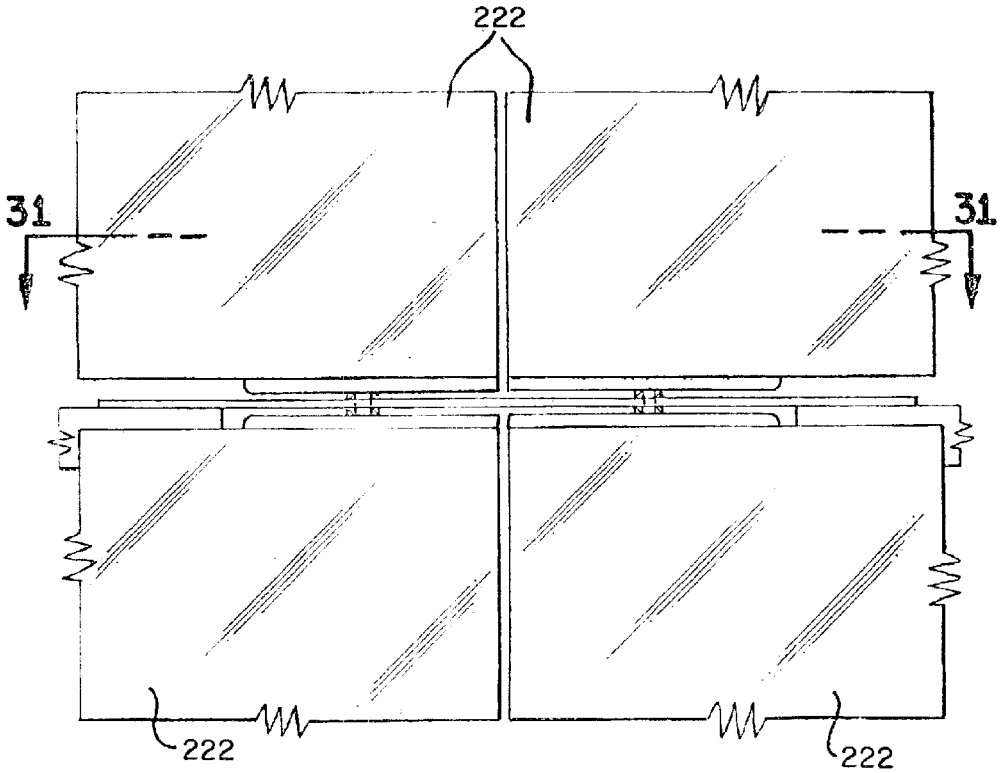
FIG. 30 is an enlarged view of a portion of the four doors illustrated in FIG. 29 taken in the vicinity of line 30—30.
Figure 31:
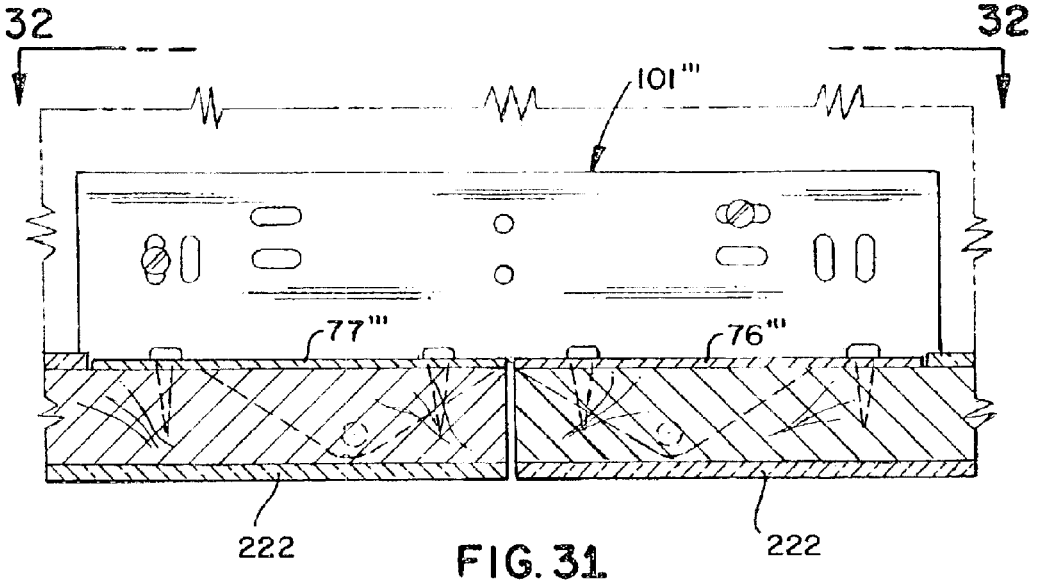
FIG. 31 is top plan view of a portion of the hinge shown in FIG. 30 taken along line 31—31 with a portion of the doors shown in cross section.
Figure 32:
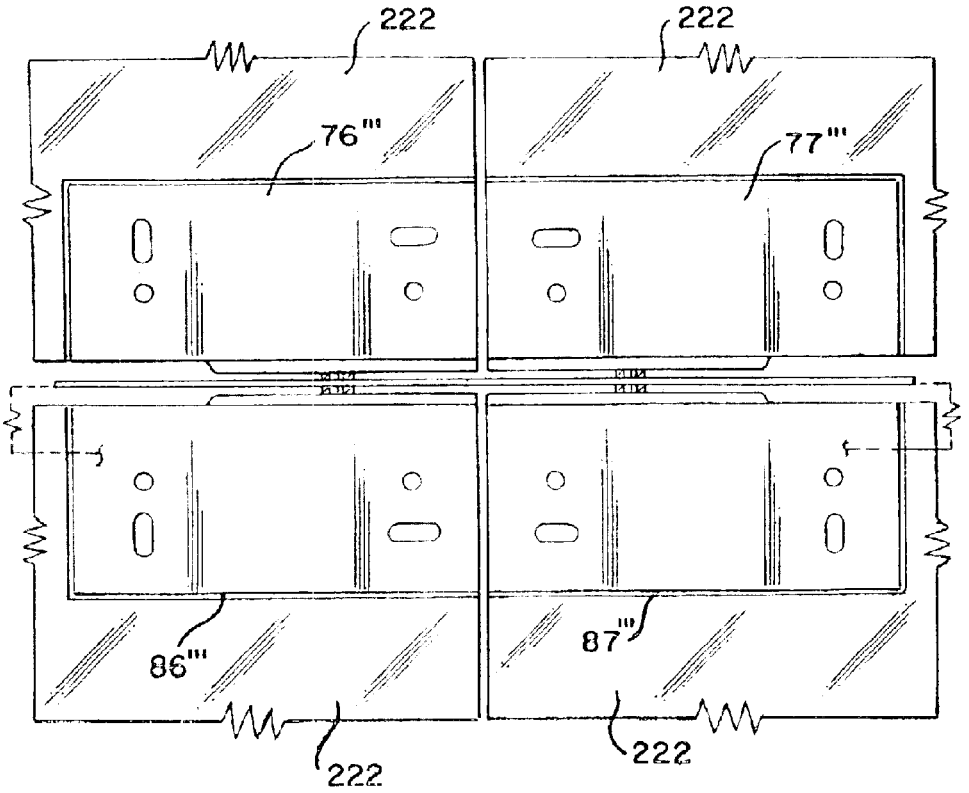
FIG. 32 is a rear elevation view of the hinge and portions of the doors shown in FIG. 31 taken along line 32—32.

The cabinet illustrated in FIGS. 29–32 is identical to the cabinet illustrated in FIG. 10 except that mirrors 222 have been mounted on the front faces of the doors. The hinges in the cabinets illustrated in FIGS. 10 and 29 are identical and are not further described for purposes of brevity. FIGS. 29–32 are included to illustrate the versatility of the hinges described previously.

Figure 14:
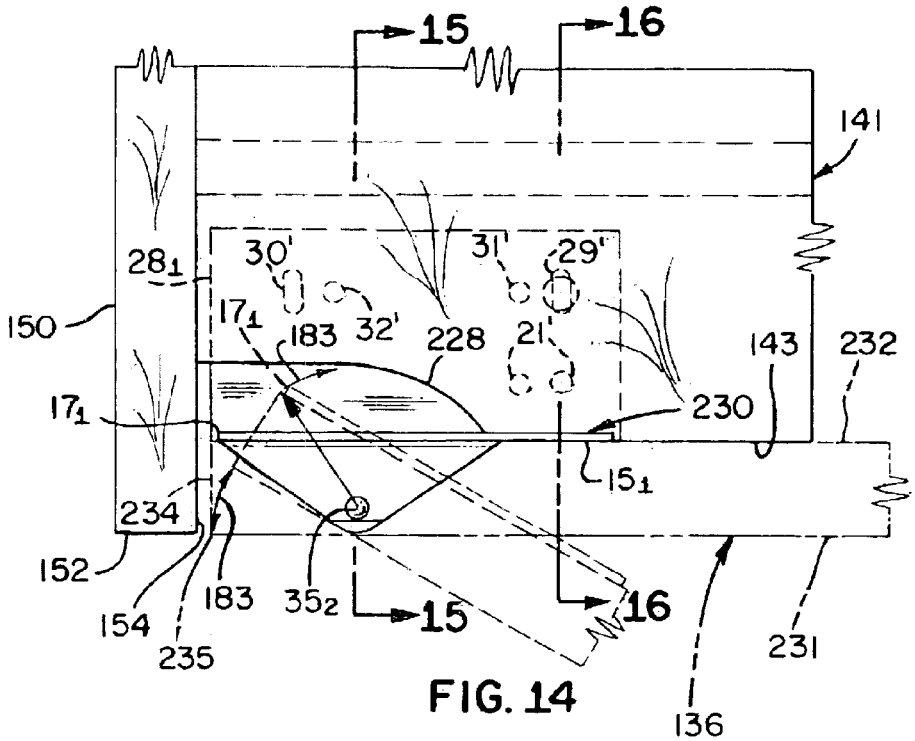
FIG. 14 is an enlarged top plan view of a form of the present invention taken along lines 14—14 in FIG. 10, portions of the hinge are shown in phantom line. A portion of the door in the partially open position is shown in phantom line.
Figure 15:
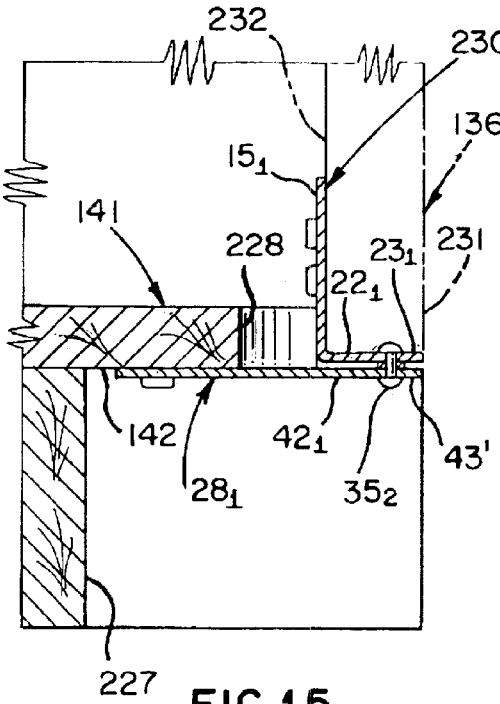
FIG. 15 is a cross sectional view taken along line 15—15 in FIG. 14, portions of the door are shown in phantom line.
Figure 16:
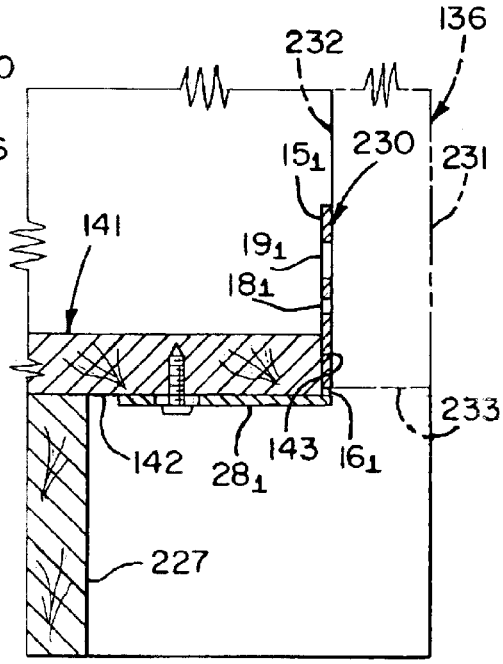
FIG. 16 is a cross sectional view taken along line 16—16 in FIG. 14, Portions of the door are shown in phantom line.
Figure 22:
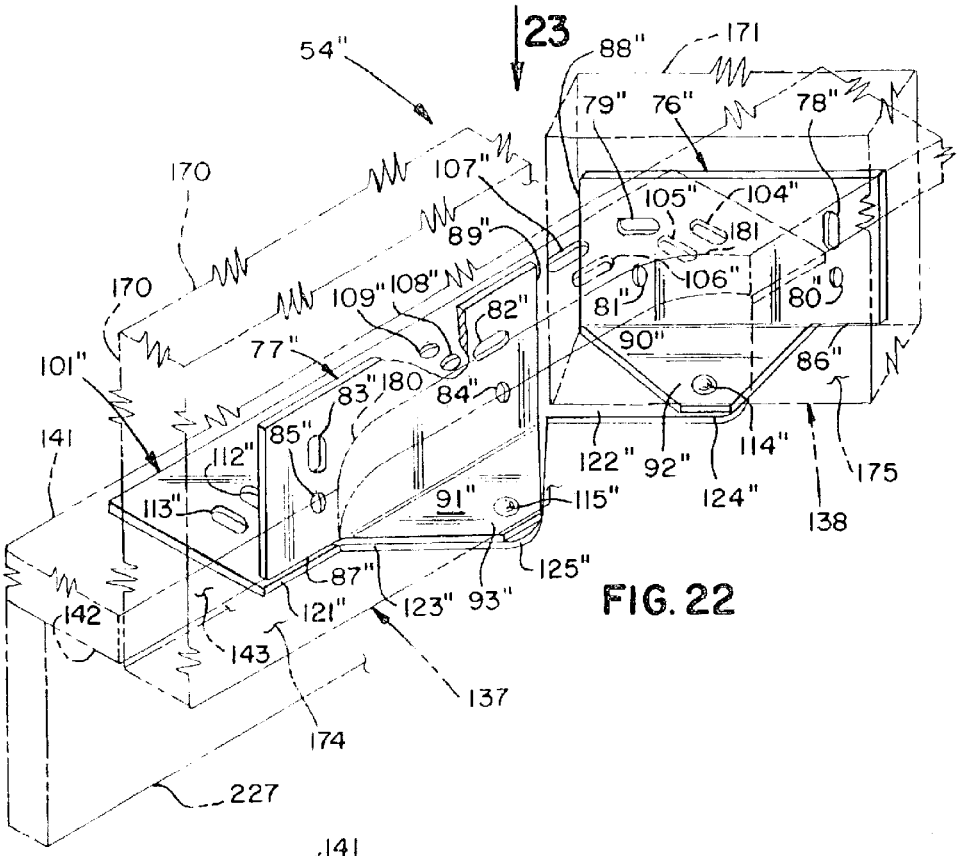
FIG. 22 is a perspective view of another form of hinge of the present invention taken along line 22—22 in FIG. 10. Portions of the cabinet shelf on which the hinge are mounted is show phantom line. Portions of the doors attached to the hinges are shown in phantom line. The door on the right side of the drawing has been swung to a partially open position.
Figure 23:
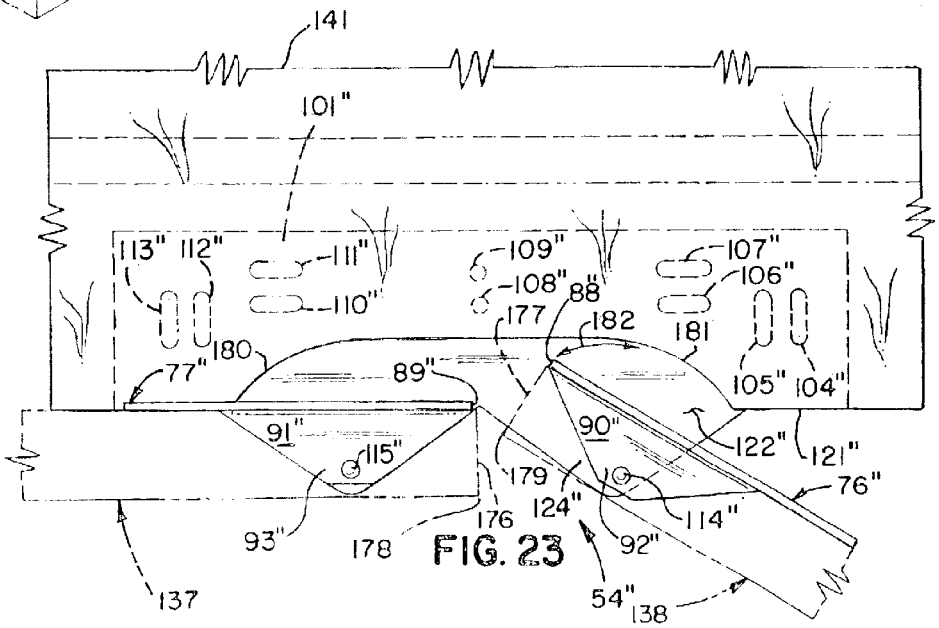
FIG. 23 is a top plan view of the hinge illustrated in FIG. 22. Portions of the doors and lower horizontal frame member are shown in phantom line. The door on the right is shown in the partially opened position. The arcuate lines in the lower frame member are cutouts to permit the lower doors to open freely.

In FIG. 10, a lower door 136 is mounted on a bottom horizontal frame member 141 which also may be a shelf and is also more clearly shown in FIGS. 14–16. Planar rear face portion 232 of door 136 is flush with the planar front face portion 143 of bottom horizontal frame member 141. Door 136 overlies the planar front face portion 143 of bottom horizontal frame member 141, This construction is known as a "flush overlay". This construction permits door 136 to have its planar front face portion 231 flush with the planar front face portion 152 of first vertical frame member 150. This is especially useful where there is a toe board 227 as shown in FIGS. 10, 25, and 16 providing a "toe kick space below the cabinet 130 as shown in FIG. 10. This same construction is also shown in FIG. 22 which is taken in the vicinity of line 22—22 in FIG. 10 and is previously described above.

In FIGS. 10, and 14–16, concealed hinge 230 and its attached relationship to door 136 and cabinet 10 is described.

The unique construction consists of a door 136, a frame 131 including a bottom horizontal frame member 141 having a planar lower surface portion 142 formed with an arcuate cut out 228, and a first generally vertical frame member 150, a concealed hinge 230 for the door 136 movable from a closed to an open position, the door 136 having a substantially planar front face portion 231 and a rear substantially planar face portion 232, and a generally parallel planar bottom edge face portion 233 and a substantially planar end face portion 234 intersecting the substantially planar front face portion 231 and forming a front pivot door corner 235. Door 136 is mounted in the frame 131 with the bottom edge face 233 of the door 136 positioned generally coextensive with the lower surface portion 142 of the bottom horizontal frame member 141 and the generally vertical frame member 150 having a substantially planar front face portion 152 and presenting a substantially planar side face portion 154 generally parallel to and closely spaced from the planar door end face portion 234 and the front pivot corner 235 when the first door 136 is in the closed position.

The concealed hinge 230 includes: an elongated door plate member $\mathbf{15}_1$ having a lower edge $\mathbf{16}_1$ and a side edge $\mathbf{17}_1$ formed with fastener openings $\mathbf{18}_1$, $\mathbf{19}_1$ therethrough, and a projection member $\mathbf{22}_1$ extending from the lower edge $\mathbf{16}_1$ of the door plate member $\mathbf{15}_1$ to a narrow distal end $\mathbf{23}_1$ and at an angle thereto and the door plate member $\mathbf{15}_1$ is connected to a lower portion of the rear face portion 232 of the door 136 adjacent the door front pivot corner 235.

Concealed hinge 230 further consists of a hinge base plate member $\mathbf{28}_1$ formed with fastener openings 21', 29'–32' connected to the planar lower surface portion 142 of the bottom horizontal frame member 141.

A pivot means $\mathbf{35}_2$ is connected to the narrow distal end $\mathbf{23}_1$ of the door plate projection member $\mathbf{22}_1$ and to the hinge base plate member $\mathbf{28}_1$.

The pivot means $\mathbf{35}_2$ is located with respect to the elongated door plate member $\mathbf{15}_1$and the hinge base plate member $\mathbf{28}_1$ adjacent the substantially planar front face portion 231 of the door 136 and adjacent the planar door end face portion 234 at a point sufficient distance from the planar side face portion 154 of the vertical frame member 150 and from the substantially planar front face portion 231 of the door 136 so that the arc 184 scribed by the front pivot corner 235 of the door 136 adjacent the generally vertical frame member 150 when the door 136 is pivoted for rotation about the pivot means $\mathbf{35}_2$ from the closed to open positions does not intersect the planar side face portion 154 of the vertical frame member 150, and the arc 183 scribed by the side edge $\mathbf{17}_1$ of the door plate member $\mathbf{15}_1$ does not intersect the arcuate cut out 228 in the bottom horizontal frame member 141, and the planar front face portion 231 of the door 136 when in the closed position is substantially parallel to the planar front face portion 152 of the vertical frame member 150.

At least one of the fastener openings $\mathbf{19}_1$ in the door plate member $\mathbf{15}_1$is elongated in its vertical direction to permit adjustment of the relative attachment of the door 136 in a vertical direction.

At least two of the fastener openings 29', 30' in the hinge base plate member $\mathbf{28}_1$ are elongated in a direction at right angles to the door 136 when the door 136 is in its closed position so as to permit front to rear adjustment of the location of the hinge base plate member $\mathbf{28}_1$ relative to the planar front face portion 152 of the vertical frame member 150.

Figure 9:
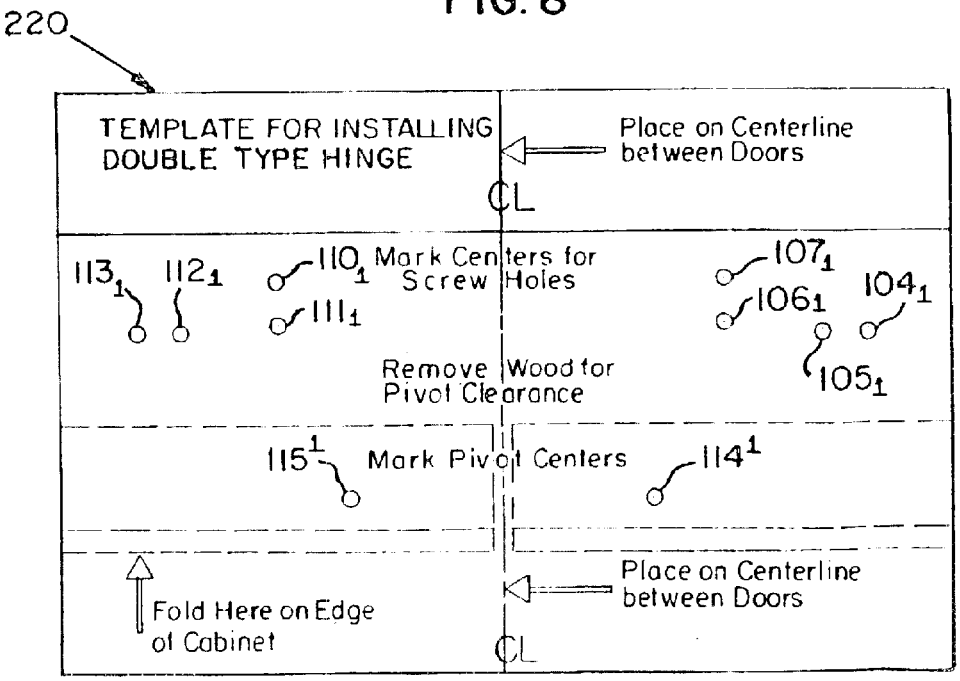
FIG. 9 is a plan view of a template used to install the hinge illustrated in FIG. 3.
Figure 17:
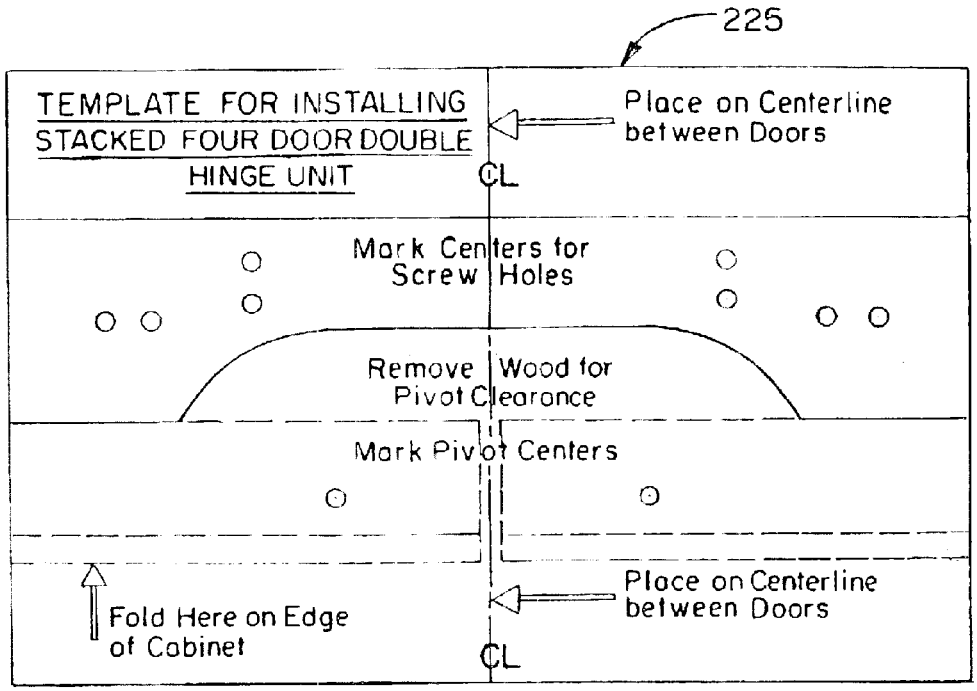
FIG. 17 is a plan view of a template used to install stacked four door Double Hinge units as illustrated in FIG. 11.

FIG. 17 is a template 225 for installing stacked four door double hinge units such as the hinge illustrated in FIG. 11 and previously described. Use of the template 225 is used in a similar manner as template illustrated in FIG. 9.

Figure 18:
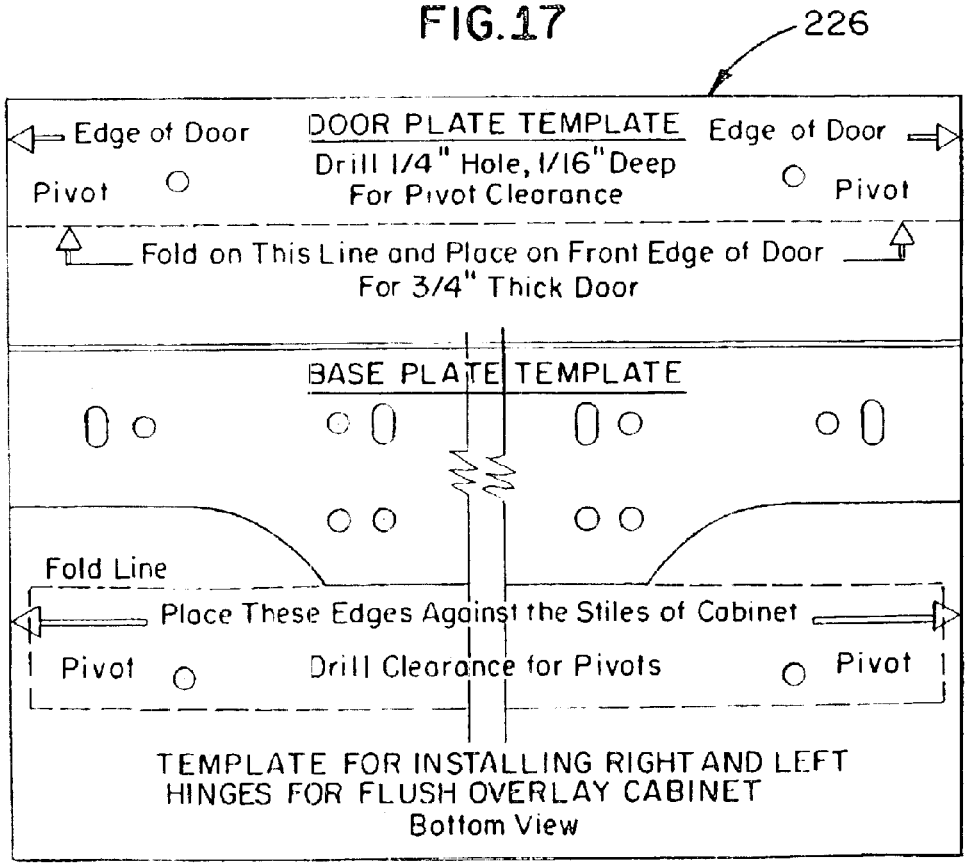
FIG. 18 is a plan view of a template used to install left and right hinges for the flush overlay hinges illustrated in FIGS. 14–16.

FIG. 18 is a template 226 used to install right and left hinges for flush overlay cabinets. As viewed in FIG. 11 these would be the hinges used for holding doors 136 and 139. Template 226 would be used in a similar manner to the templates previously described and no further description is made for purposes of brevity.

Figure 27:
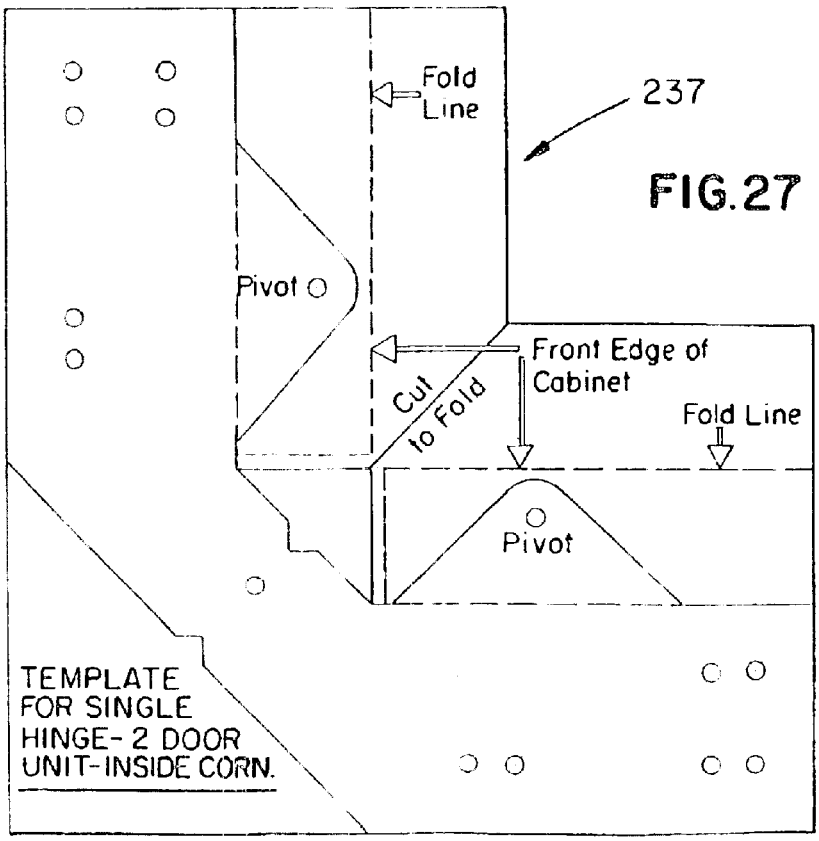
FIG. 27 is a top plan view of the hinge template used for installing a single hinge, two door unit on an inside corner.

FIG. 27 is a top plan view of the hinge template 236 used for installing a single hinge, two door unit on an inside corner.

Figure 28:
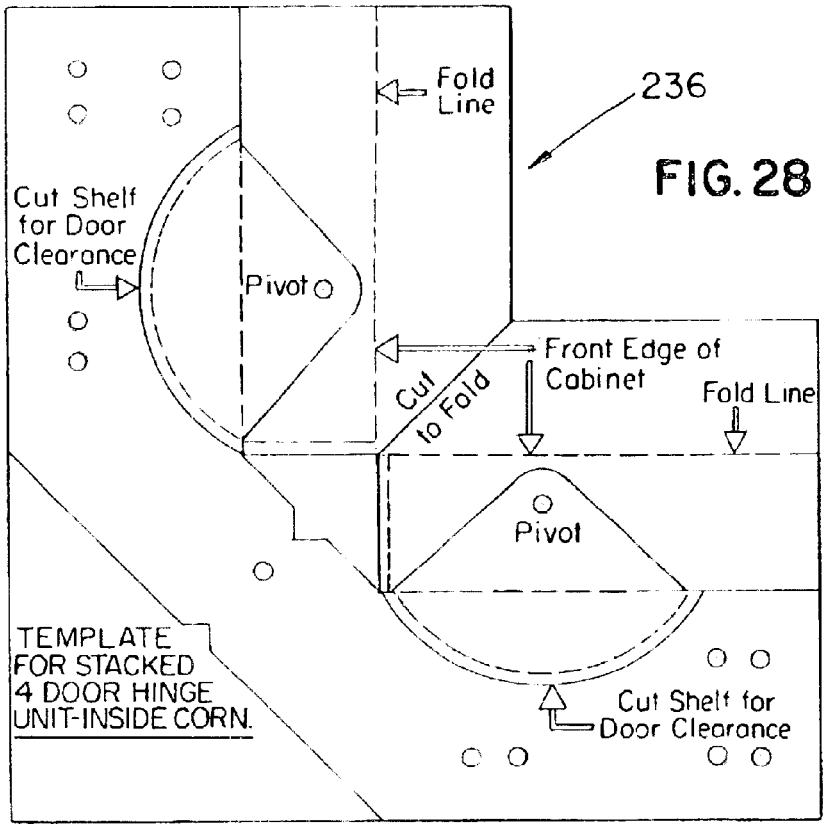
FIG. 28 is a top plan view of the hinge template used for installing a four door hinge unit on an inside corner, such as the hinge shown in FIG. 25.

FIG. 28 is a top plan view of the hinge template 237 used for installing a four door hinge unit on an inside corner, such as the hinge shown in FIG. 25.

I claim:

1. In combination, a first door, a frame, having a bottom horizontal frame member having a planar bottom frame member portion, a top horizontal frame member having a planar top frame member portion, and a first generally vertical frame member, and a pair of concealed hinges for said first door movable from a closed to an open position, said first door having a substantially planar front face portion, and a rear substantially planar face portion, and generally parallel planar top and bottom edge face portions and a substantially planar end face portion intersecting said substantially planar front face portion and forming a front pivot corner and mounted in said frame and said first generally vertical frame member having a substantially planar front face portion and presenting a substantially planar side face portion generally parallel to and closely spaced from said planar first door end face portion and said pivot corner when said first door is in said closed position; each of said concealed hinges comprising:

a. an elongated door plate member having a lower edge and a side edge formed with fastener openings therethrough, and a projection member extending from said lower edge of said door plate member to a narrow distal end and at an angle thereto and each of said door plate members being connected to respective upper and lower portions of said rear face portion of said first door adjacent said first door front pivot corner;

b. a hinge base plate member formed with fastener openings connected to said respective planar top and bottom frame member portions of said top and bottom frame members;

c. pivot means connected to said distal end of said door plate projection member and to said hinge base plate member;

d. said pivot means is located with respect to said elongated door plate member and said hinge base plate member adjacent said substantially planar front face portion of said first door and adjacent said planar first door end face portion at a point sufficient distance from said planar side face portion of said first vertical frame member and from said substantially planar front face portion of said first door so that the arc scribed by said front pivot corner of said door adjacent said first vertical frame member when said first door is pivoted for rotation about said pivot means from said closed to open positions does not intersect said planar side face portion of said first vertical frame member, and said planar front face portion of said first door when in said closed position is substantially parallel to said planar front face portion of said first vertical frame member, e. at least one of said fastener openings in said door plate member is elongated in its vertical direction to permit adjustment of the relative attachment of said first door in a vertical direction; and f. at least two of said fastener openings in said hinge base plate member are elongated in a direction at right angles to said first door when said first door is in its closed position so as to permit front to rear adjustment of the location of said hinge base plate member relative to a frame opening defined by a planar front face portion of said first vertical frame member, planar front face portion of said bottom frame member and, planar front face portion of said top horizontal frame member.

2. A combination as described in claim 1 wherein:

a. said hinge base plate member is formed with a front edge and a projection member extending from said front edge to a narrow distal end; and b. said pivot means is connected to said narrow distal end of said base plate projection member and said narrow distal end of said door plate projection member.

3. A method of installing the hinges of claim 1 and said first door in said frame comprising the steps of:

a. creating a template with indicia, locating said elongated fastener openings and indicia, and locating said pivot means in said hinge base plate member with respect to said planar front face portion and said planar side face portion of said frame;

b. placing said template alternately on said top and bottom frame member portions of said frame in alignment with said planar front face portion of said frame and said planar side face portion of said frame;

c. marking the location of said elongated fastener openings and pivot clearances alternately on said planar top and bottom frame member portions;

d. forming depressions in said top and bottom frame member portions for clearance of said pivot means;

e. placing said door plate members respectively on said substantially planar rear face portion of said door with said lower edge of said door plate member in registration with said bottom edge face of said door and said side edge of said door plate member in registration with said substantially planar end face portion of said door, and inserting fasteners through said elongated fastener openings into said door, and then installing said other door plate member in like manner in said door adjacent said top edge face of said door;

f. setting said door in said frame; and g. inserting fasteners respectively through said elongated fastener openings in said hinge base plate members and into said marked locations of said elongated fastener openings in said planar top and bottom frame member portions.

4. A combination as described in claim 3 wherein:

a. said hinge base plate member is a pair of circle like members.

5. In combination, side-by-side doors, a frame having a bottom horizontal frame member having a planar bottom frame member portion, a top horizontal frame member having a planar top frame member portion, and first and second vertical frame members and a pair of concealed double hinges for said doors mounted in edege-to-edge relationship and mounted for rotation in opposite directions from closed to open positions, said doors having substantially planar front face portions mounted in the same plane, and said doors having rear substantially planar face portions, and said doors having generally planar top and bottom edge face portions, and generally planar end face portions closely spaced from and parallel to one another when said doors are in said closed positions and said planar door end face portions intersect said planar door front face portions forming front pivot corners closely adjacent one another and said doors, are mounted in said frame defining a frame opening, and said top and bottom horizontal frame members having planar front face portions and said spaced first and second vertical frame members are joined to said too and bottom horizontal frame members, and said pairs of concealed double hinges each comprising:

a. a pair of elongated door plate members each formed with fastener openings therethrough, and each having a lower edge and a side edge and a projection member extending to a narrow distal end from said lower edge of each of said door plate members at an angle thereto and each door plate member being connected to said respective upper and lower rear faces of said doors adjacent said door front pivot corners;

b. a hinge base plate member connected to said respective planar top and bottom frame member portions and formed with hinge base plate fastener openings therethrough;

c. pivot means connected to said narrow distal ends of said door plate projection members and to said hinge base plate member;

d. said pivot means are located with respect to said elongated door plate members and said hinge base plate member, and adjacent said substantially planar front face portions of said doors and adjacent said planar door end face portions at a point sufficient distance from said adjoining planar end face portions of said doors and from said planar front face portions of said doors so that the arcs scribed by said front pivot corners of each of said doors in edge to edge relationship do not intersect one another when said doors are pivoted about said second and third pivot means from said closed to open positions, and said substantially planar front face portions of said doors when in said closed position are substantially parallel to each other;

e. at least one of said fastener openings in each of said elongated door plate members is elongated in its vertical direction to permit independent adjustment of said respective doors in a vertical direction relative to said elongated door plate members; and f. at least two of said fastener openings in said hinge base plate member are elongated in a direction at right angles to said doors when said doors are in their closed position so as to permit front to rear adjustment of the location of said hinge base plate member relative to said frame opening defined by said, planar front face portion of said bottom frame member and planar front face portion of said top horizontal frame member.

6. A method of installing the hinges of claim 5 and said side-by-side doors in said frame comprising the steps of;

a. creating a template with indicia locating said hinge base plate fastener openings, indicia locating pivot clearances in said hinge base plate member and said center line of said hinge base plate member with respect to said planar front face portion of said frame and said center line between said doors;

b. placing said template alternately on said top and bottom frame member portions of said frame in alignment with said planar front face portion of said frame and said center line between said doors;

c. marking the location of said elongated fastener openings and said pivot clearances alternately on said planar top and bottom frame member portions;

d. forming depressions in said top and bottom frame member portions for clearance of said pivot means;

e. placing said door plate members respectively on said substantially planar lower rear face portions of said doors with said lower edges of said door plate members in registration with said bottom edge faces of said doors and said side edges of said door plate members in registration with said substantially planar end face portions of said doors, and then installing said other door plate members in like manner on said doors adjacent said top edge faces of said doors;

f. setting said doors in said frame; and g. inserting fasteners respectively through said elongated fastener openings in said hinge base plate members and into said marked locations of said elongated fastener openings in said planar top and bottom flange member portions.

7. A combination as described in claim 5 comprising:

a. said hinge base plate member is formed with a front edge and a pair of projection members extending from said front edge to narrow distal ends; and b. said pivot means are connected to said narrow distal ends of said base plate projection members and said narrow distal ends of said door plate projection members.

8. In combination, a cabinet having a frame, doors hingedly mounted on said cabinet frame, and upper, lower intermediate concealed double hinges, and intermediate concealed quad hinges mounting said doors on said cabinet frame;

A. said cabinet frame including;

1) a bottom horizontal frame member having an under side planar bottom frame member portion and a planar front face portion formed with a pair of arcuate cut outs, 2) a top horizontal frame member having a planar top frame member portion and a planar front face portion, 3) an intermediate frame member located between said top and bottom frame members having a planar upper portion and a planar front face portion formed with a pair of arcuate cut outs, 4) first and second spaced vertical frame members supporting said bottom, top and intermediate frame members and each having planar front face portions and side face portions;

B. said doors including:

1) upper side-by-side doors, hingedly mounted on said top horizontal frame member and said intermediate frame member, positioned in edge-to-edge relationship, and mounted for rotation in opposite directions from closed to open positions, said upper side-by-side doors having substantially planar front face portions positioned in the same plane in said closed position, and substantially planar rear face portions substantially parallel to said planar front face portions, and said upper side-by-side doors having generally planar top and bottom edge face portions, and generally planar end face portions closely spaced from and parallel to one another when said upper side-by-side doors are in said closed position and said planar door end face portions intersect said planar door front face portions respectively forming upper door front pivot corners closely adjacent one another, and 2) lower side-by-side doors hingedly mounted on said intermediate frame member and said bottom frame member adjacent and below said upper side-by-side doors in edge to edge relationship and mounted for rotation in opposite directions from closed to open positions, said lower side-by-side doors having substantially planar front face portions, positioned to each other in the same plane in said closed position, and positioned in the same plane as said front face portions of said upper side-by-side doors, and substantially planar rear face portions substantially parallel to said planar front face portions, and said lower side-by-side doors having generally planar top and bottom edge face portions, and generally planar end face portions closely spaced from and parallel to one another when said lower side-by-side doors are in said closed position and said planar door end face portions of said lower side-by-side doors intersect said planar door front face portions respectively forming lower door front pivot corners closely adjacent one another and, C. said upper concealed double hinges comprising:

1) a pair of elongated upper door plate members each formed with fastener openings therethrough, and each having a projection edge and a side edge and a projection member extending to a narrow distal end from said projection edge of each of said upper door plate members at an angle thereto and each door plate member being connected to said respective upper rear face portions of said upper side-by-side doors adjacent said respective upperdoor front pivot corners;

2) an upper hinge base plate member, formed with fastener openings connected to said planar top frame member portion and formed with a front edge and a pair of spaced projection members extending from said front edge to narrow distal ends;

3) upper pivot means connected to said narrow distal ends of said door plate projection members and to said narrow distal ends of said projection members of said upper hinge base plate member;

4) said upper pivot means are located with respect to said respective elongated upper door plate members and said upper hinge base plate member; and adjacent said substantially planar front face portions of said upper side-by-side doors and adjacent said planar door end face portions at a point sufficient distance from said adjoining planar end face portions of said upper side-by-side doors and from said planar front face portions of said upper side-by-side doors so that the arcs, scribed by said upper door front pivot corners do not intersect one another when said upper side-by-side doors are pivoted about said upper pivot means from said closed to open positions, and said substantially planar front face portions of said upper side-by-side doors when in said closed position are substantially parallel to the plane of said front faces of said first and second vertical frame members;

5) at least one of said fastener openings in each of said elongated upper door plate members is elongated in its vertical direction to permit independent adjustment of said respective upper side-by-side doors in a vertical direction relative to said elongated upper door plate members; and 6) at least two of said fastener openings in said upper hinge base plate member are elongated in a direction at right angles to said upper side-by-side doors when said upper side-by-side doors are in their closed position so as to permit front to rear adjustment of the location of said upper hinge base plate member relative to said planar front face portions of said first and second vertical frame members, and planar front face portions of said bottom and top horizontal frame members;

D. said lower concealed double hinges comprising:

1) a pair of elongated lower door plate members each formed with fastener openings therethrough, and each having a projection edge and a side edge and a projection member extending to a narrow distal end from said projection edge of each of said lower door plate members at an angle thereto and each door plate member being connected to said respective lower rear face portions of said lower side-by-side doors adjacent said respective lower door front pivot corners;

2) a lower hinge base plate member, formed with fastener openings, connected to said under side planar bottom frame member portion of said bottom horizontal frame member and formed with a front edge and a pair of spaced projection members, extending from said front edge to narrow distal ends;

3) said front edge of said lower hinge base plate member is positioned generally flush with said planar front face portion of said bottom horizontal frame member;

4) lower pivot means connected to said narrow distal ends of said door plate projection members and to said narrow distal ends of said projection members of said lower hinge base plate member;

5) said lower pivot means are located with respect to said respective elongated lower door plate members and said lower hinge base plate member; and adjacent said substantially planar front face portions of said lower side-by-side doors and adjacent said planar door end face portions at a point sufficient distance from said adjoining planar end face portions of said lower side-by-side doors and from said planar front face portion of said lower side-by-side doors so that the arcs, scribed by said lower door front pivot corners, do not intersect one another and the arcs scribed by said edges of said door plate members do not intersect said pair of arcuate cut outs in said planar front face portion of said bottom horizontal frame member when said lower side-by-side doors are pivoted about said lower pivot means from said closed to open positions, and said substantially planar front face portions of said lower side-by-side doors when in said closed position are substantially parallel to the plane of said planar front faces of said upper side-by-side doors;

6) at least one of said fastener openings in each of said lower elongated door plate members is elongated in its vertical direction to permit independent adjustment of said respective lower side-by-side doors in a vertical direction relative to said lower elongated door plate members; and 7) at least two of said fastener openings in said lower hinge base plate member are elongated in a direction at right angles to said lower side-by-side doors when said lower side-by-side doors are in their closed position so as to permit front to rear adjustment of the location of said lower hinge base plate member relative to said planar front face portion of said bottom horizontal frame member and planar front face portions of said bottom and top horizontal frame members; and E. said intermediate concealed quad hinges comprising:

1) a pair of upper elongated intermediate door plate members each formed with fastener openings therethrough, and each having a projection edge and a side edge and a projection member extending to a narrow distal end from said projection edge of each of said upper door plate members at an angle thereto and each upper door plate member being connected to said respective lower rear face portions of said upper side-by-side doors adjacent said respective upper door front pivot corners;

2) an intermediate hinge base plate member, formed with fastener openings, connected to said planar upper portion of said intermediate frame member and formed with a front edge and a pair of spaced projection members extending from said front edge to narrow distal ends;

3) said front edge of said intermediate hinge base plate member is positioned generally flush with said planar front face portion of said intermediate frame member;

4) intermediate pivot means connected to said narrow distal ends of said door plate projection members of said upper elongated door plate members and to said narrow distal ends of said projection members of said upper intermediate hinge base plate member;

5) said intermediate pivot means are located with respect to said respective elongated upper door plate members and said intermediate hinge base plate member; and adjacent said substantially planar lower front face portions of said upper side-by-side doors and adjacent said planar lower door end face portions at a point sufficient distance from said adjoining planar lower end face portions of said upper side-by-side doors and from said planar lower front face portions of said upper side-by-side doors so that the arcs scribed by said lower door front pivot corners do not intersect one another when said upper side-by-side doors are pivoted about said intermediate pivot means from said closed to open positions, and said substantially planar front face portions of said upper side-by-side doors when in said closed position are substantially parallel to the plane of said front faces of said first and second vertical frame members;

6) at least one of said fastener openings in each of said elongated upper door plate members is elongated in its vertical direction to permit independent adjustment of said respective upper side-by-side doors in a vertical direction relative to said upper elongated door plate members; and 7) at least two of said fastener openings in said intermediate hinge base plate member are elongated in a direction at right angles to said upper intermediate doors when said upper intermediate doors are in their closed position so as to permit front to rear adjustment of the location of said hinge base plate member relative to said planar front face portion of said first and second vertical frame members, and planar front face portions of said bottom and top horizontal frame members;

8) a pair of elongated intermediate lower door plate members each formed with fastener openings therethrough, and each having a projection edge and a side edge and a projection member extending to a narrow distal end from said projection edge of each of said lower door plate members at an angle thereto and each lower door plate member being connected to said respective upper rear face portions of said lower side-by-side doors adjacent said respective lower side-by-side door front pivot corners;

9) said door plate projection members of said lower elongated door plate members are connected to said intermediate pivot means;

10) said intermediate pivot means are located with respect to said respective elongated lower door plate members and said hinge base plate member; and adjacent said substantially planar upper front face portions of said lower side-by-side doors and adjacent said planar upper door end face portions at a point sufficient distance from said adjoining planar upper end face portions of said lower side-by-side doors and from said planar lower front face portion of said lower side-by-side doors so that the arcs scribed by said upper door front pivot corners of said lower side-by-side doors do not intersect one another and the arcs scribed by said edges of said door plate members do not intersect said pair of arcuate cut outs in said planar front face portion of said intermediate frame member when said lower side-by-side doors are pivoted about said intermediate pivot means from said closed to open positions, and said substantially planar front face portions of said lower side-by-side doors when in said closed position are substantially parallel to the plane of said front faces of said second and first vertical frame members; and 11) at least one of said fastener openings in each of said elongated lower door plate members is elongated in its vertical direction to permit independent adjustment of said respective lower side-by-side doors in a vertical direction relative to said elongated lower door plate members.

9. In combination, a cabinet having a frame, doors, including upper side-by-side doors and lower side-by-side doors hingedly mounted on said cabinet frame and upper, lower and intermediate concealed hinges mounting said doors on said cabinet frame as described in claim 8 comprising:

a. said cabinet frame is formed with an inside 90° corner;

b. said upper concealed double hinges are modified so that said upper hinge base plate member is formed to present said pair of elongated upper door plate members initially at a 90° angle to one another when said upper side-by-side doors are closed;

c. said lower concealed double hinges are modified so that said lower hinge base plate member is formed to present said pairs of elongated lower door plate members initially at a 90° angle to one another when said lower side-by-side doors are closed;

d. said intermediate concealed quad hinge are modified so that said intermediate hinge base plate member is formed to present said pairs of upper and lower intermediate door plate members initially at a 90° angel to one another when said upper and lower side-by-side doors are closed; and e. said upper and lower side by side doors are mounted at an angle of 90° to one another on said upper modified concealed hinges, said lower modified concealed hinges, and said intermediate modified concealed hinges.

10. In combination, a cabinet having a frame, at least two doors mounted one above the other and hingedly mounted on said cabinet frame, and intermediate concealed hinges mounting said doors on said cabinet frame;

A. said cabinet frame including;

1) a top frame member, 2) a bottom frame member, 3, an intermediate frame member located between said top and bottom frame members having a planar upper portion and a planar front face portion formed with an arcuate cut out, 4) a vertical frame member supporting said bottom, top and intermediate frame members and having a planar front face portion and a planar side face portion;

B. said doors including:

1) an upper door, hingedly mounted on said top frame member and said intermediate frame member, and mounted for rotation from closed to open positions, and having a substantially planar front face portion and a substantially planar rear face portion substantially parallel to said planar front face portion, and said upper door having a generally planar bottom edge face portion, and a generally planar end face portion closely spaced from and parallel to said planar side face portion of said vertical frame member when said door is in said closed position, and said planar door end face portion intersects said planar door front face portion forming a front pivot corner closely adjacent said vertical frame member; and 2) a lower door hingedly mounted on said intermediate frame member and said bottom frame member adjacent and below said upper door in edge-to-edge relationship and mounted for rotation from closed to open positions, said lower door having a substantially planar front face portion, positioned in the same plane as said front face portion of said upper door, and a substantially planar rear face portion substantially parallel to said planar front face portion, and said lower door having a generally planar top edge face portion, and a generally planar end face portion closely spaced from and parallel to said planar side face portion of said vertical frame member when said lower door is in said closed position and said planar door end face portion of said lower door intersects said planar door front face portion forming a front pivot corner closely adjacent said vertical frame member, C. said intermediate concealed hinges comprising:

1) an upper elongated door plate member formed with fastener openings therethrough, and having a projection edge and a side edge, and a projection member extending to a narrow distal end from said projection edge of said upper door plate member at an angle thereto and said upper door plate member being connected to said lower rear face portion of said upper door adjacent said upper door front pivot corner;

2) a hinge base plate member, formed with fastener openings, connected to said planar upper portion of said intermediate frame member and formed with a front edge and a projection member extending from said front edge to a narrow distal end;

3) said front edge of said hinge base plate member is positioned generally flush with said planar front face portion of said intermediate frame member;

4) a pivot means connected to said narrow distal end of said door plate projection member and said narrow distal end of said projection member of said hinge base plate member;

5) said pivot means is located with respect to said elongated upper door plate member and said hinge base plate member and adjacent said substantially planar lower front face portions of said upper and lower doors and adjacent said planar upper and lower door end face portions at a point sufficient distance from said adjoining planar lower end face portions of said upper and lower doors and from said planar lower front face portions of said upper and lower doors, so that the arcs scribed by said upper and lower door front pivot corners do not intersect said planar side face portion of said vertical frame member when said doors are pivoted about said pivot means from said closed to open positions, and said substantially planar front face portions of said upper and lower doors when in said closed position are substantially parallel to the plane of said front face of said vertical frame member;

6) at least one of said fastener openings in said elongated upper door plate member is elongated in its vertical direction to permit independent adjustment of said upper door in a vertical direction relative to said elongated upper door plate member; and 7) at least two of said fastener openings in said hinge base plate member are elongated in a direction at right angles to said upper and lower doors when said upper and lower doors are in their closed position so as to permit front to rear adjustment of the location of said hinge base plate member relative to said planar front face portion of said vertical frame member;

8) an elongated lower door plate member formed with fastener openings therethrough having a projection edge and a side edge and a projection member extending to a narrow distal end from said projection edge of said lower door plate member at an angle thereto and said lower door plate member being connected to said upper rear face portion of said lower door adjacent said lower door front pivot corner;

9) said door plate projection member of said lower elongated door plate member is connected to said pivot means;

10) said pivot means is located with respect to said elongated lower door plate member and said hinge base plate member; and adjacent said substantially planar upper front face portion of said lower door and adjacent said planar lower door end face portion at a point sufficient distance from said adjoining planar upper end face portion of said lower door and from said planar lower front face portion of said lower door so that the arc scribed by said lower door front pivot corner does not intersect said planar side face portion of said vertical frame member and does not intersect said arcuate cut out in said planar front face portion of said intermediate frame member, when said lower door is pivoted about said pivot means from said closed to open positions, and said substantially planar front face portions of said upper and lower doors when in said closed position are substantially parallel to each other and to the plane of said front face of said vertical frame member; and 11) at least one of said fastener openings in said elongated lower door plate member is elongated in its vertical direction to permit independent adjustment of said lower door in a vertical direction relative to said elongated lower door plate member.

11. In combination, a door, a frame including a bottom horizontal frame member having a planar lower surface portion formed with an arcuate cut out, and a first generally vertical frame member, a concealed hinge for said door movable from a closed to an open position, said door having a substantially planar front face portion and a rear substantially planar face portion, and a generally parallel planar bottom edge face portion and a substantially planar end face portion intersecting said substantially planar front face portion and forming a front pivot door corner and mounted in said frame with said bottom edge face of said door positioned generally coextensive with said lower surface portion of said bottom horizontal frame member and said generally vertical frame member having a substantially planar front face portion and presenting a substantially planar side face portion generally parallel to and closely spaced from said planar door end face portion and said front pivot corner when said first door is in said closed position; said concealed hinge comprising:

a. an elongated door plate member having a lower edge and a side edge formed with fastener openings therethrough, and a projection member extending from said lower edge of said door plate member to a narrow distal end and at an angle thereto and said door plate member being connected to a lower portion of said rear face portion of said door adjacent said door front pivot corner;

b. a hinge base plate member formed with fastener openings connected to said planar lower surface portion of said bottom horizontal frame member;

c. pivot means connected to said narrow distal end of said door plate projection member and to said hinge base plate member;

d. said pivot means is located with respect to said elongated door plate member and said hinge base plate member adjacent said substantially planar front face portion of said door and adjacent said planar door end face portion at a point sufficient distance from said planar side face portion of said vertical frame member and from said substantially planar front face portion of said door so that the arc scribed by said front pivot corner of said door adjacent said generally vertical frame member when said door is pivoted for rotation about said pivot means from said closed to open positions does not intersect said planar side face portion of said vertical frame member, and the arc scribed by said side edge of said door plate member does not intersect the arcuate cut out in said bottom horizontal frame member, and said planar front face portion of said door when in said-closed position is substantially parallel to said planar front face portion of said vertical frame member, e. at least one of said fastener openings in said door plate member is elongated in its vertical direction to permit adjustment of the relative attachment of said door in a vertical direction; and f. at least two of said fastener openings in said hinge base plate member are elongated in a direction at right angles to said door when said door is in its closed position so as to permit front to rear adjustment of the location of said hinge base plate member relative to said planar front face portion of said vertical frame member.

* * * * *